United States Patent [19]

Izu et al.

[11] 4,082,861

[45] Apr. 4, 1978

[54] CONTINUOUS TONE IMAGING FILM

[75] Inventors: Masatsuga Izu, Birmingham; Stanford R. Ovshinsky, Bloomfield Hills, both of Mich.

[73] Assignee: Energy Conversion Devices, Inc., Troy, Mich.

[21] Appl. No.: 725,926

[22] Filed: Sep. 23, 1976

[51] Int. Cl.[2] ..... B95C 5/00; G03C 5/16; G03C 5/04

[52] U.S. Cl. ..... 427/56; 96/27 E; 96/33; 96/44; 96/48 QP; 250/316; 250/317; 427/43; 427/53

[58] Field of Search ..... 96/1.5, 27 E, 27 R, 96/33, 48 PQ, 44, 88, 48 R, 36.3, 67, 68; 250/316, 317; 427/43, 53, 56

[56] References Cited

U.S. PATENT DOCUMENTS

| | | | |
|---|---|---|---|
| 3,392,020 | 7/1968 | Yutzy et al. | 250/317 |
| 3,549,733 | 12/1970 | Caddell | 96/35.1 |
| 3,716,844 | 2/1973 | Brodsky | 96/88 |
| 3,804,620 | 4/1974 | Wells | 96/33 |
| 4,000,334 | 12/1976 | Hallman et al. | 427/56 |

*Primary Examiner*—Edward C. Kimlin

*Attorney, Agent, or Firm*—Wallenstein, Spangenberg, Hattis & Strampel

[57] ABSTRACT

A continuous tone dry process imaging film includes a solid, high optical density and substantially opaque film of dispersion imaging material deposited on a substrate. Energy is applied to the film of dispersion imaging material, in an amount sufficient to increase the absorbed energy in the material above a certain critical value, to change the same to a substantially fluid state in which the surface tension of the material acts to cause the film, where subject to the applied energy, to disperse and change to a discontinuous film comprising openings and deformed material which are frozen in place following the application of said energy and through which openings light can pass. Means are associated with the film of dispersion imaging material for retarding the change to the discontinuous film, caused by the surface tension, and for controlling the amount of such change in accordance with the intensity of the applied energy above said certain critical value to increase the amount of such change and the area of the openings in the film and decrease the area of the deformed material in the film and, therefore, the optical density in accordance with the intensity of the applied energy above said certain critical value for providing continuous tone imaging.

41 Claims, 14 Drawing Figures

CONTINUOUS TONE IMAGING FILM

This application is generally related to application Ser. No. 162,842, filed July 15, 1971, by Robert W. Hallman, Stanford R. Ovshinsky and John P. deNeufville and now abandoned: pending application Ser. No. 577,003, filed May 13, 1975, by Robert W. Hallman, Stanford R. Ovshinsky and John P. deNeufville, as a division and continuation-in-part of said application Ser. No. 162,842; pending application Ser. No. 407,944 filed Oct. 19, 1973, now U.S. Pat. No. 4,000,334, by Robert W. Hallman, Stanford R. Ovshinsky and John P. deNeufville, as a continuation-in-part of said application Ser. No. 162,842; pending application Ser. No. 507,049, now abandoned, filed Sept. 18, 1974, by Harvey H. Wacks and Donald J. Sarrach; application Ser. No. 458,715, filed Apr. 8, 1974, by Harvey H. Wacks, Peter H. Klose, Stanford R. Ovshinsky and Robert W. Hallman and now U.S. Pat. No. 3,966,317.

The first three of the aforementioned applications, namely, Ser. Nos. 162,842, 577,003, and 407,944, are directed to a method of producing an image utilizing a solid, continuous film of a dispersion imaging material on a substrate which, upon application of a short pulse of high intensity radiant energy in an amount sufficient to increase the absorbed energy in the material above a certain threshold value, is capable of changing to a substantially molten state in which the surface tension of the material acts to cause the continuous film, where subject to the energy pulse, to change to a discontinuous film comprising spaced globules and free space therebetween which are frozen in place following the energy pulse and through which free space light can pass.

A short pulse of high intensity radiant energy is applied, preferably, through an imaging mask having a full format image pattern including portions of higher transmissiveness and portions of lower transmissiveness for the energy pulse, to the continuous film of dispersion imaging material in a full format pattern. The full format pattern of the applied energy pulse includes a plurality of areas in which the intensity and pulse width of the energy pulse is sufficient to increase the absorbed energy in the corresponding pattern areas of the dispersion imaging material above the threshold value, and wherein the amount of the radiant energy pulse supplied in a plurality of other areas is insufficient to increase the absorbed energy above the threshold value. As a result the material of the continuous film in those pattern areas receiving the higher amount of the energy pulse changes to the discontinuous film comprising the spaced globules and free space therebetween in the pattern areas which are frozen in place following the energy pulse and through which free space light can pass to provide a stable finished full format image pattern of the discontinuous film in the continuous film corresponding to the full format pattern of the energy pulse.

The fourth of the aforementioned applications, namely, Ser. No. 507,049, is directed to the imaging system as discussed above in connection with the first three applications but, in addition, it includes a thin film of a polymeric resin on the film of dispersion imaging material for protecting the same against abrasion or the like.

The fifth of the aforementioned applications, namely, Ser. No. 458,715, now U.S. Pat. No. 3,966,317, is directed to a dry-process apparatus for producing archival microform records from light reflecting hard copy and which may utilize as a part thereof the imaging system and the film of the dispersion imaging material as set forth in the first four of the aforementioned applications.

Basically, among other things, the instant invention constitutes a basic improvement over the inventions of the aforementioned applications by providing continuous tone or gray scale imaging, as compared with the high contrast imaging of the aforementioned applications, in a solid, high optical density and substantially opaque film of a dispersion imaging materal. Accordingly, the principal objects of this invention are to provide a dry-process method of continuous tone imaging in such a film of dispersion imaging material, a continuous tone dry-process imaging film capable of use in such method, and a method of making such a dry-process imaging film.

Briefly, in accordance with this invention, the continuous tone dry process imaging film includes a substrate, a solid, high optical density and substantially opaque film of a dispersion imaging material deposited on the substrate and, preferably, an overcoat film deposited on the outer surface of the film of dispersion imaging material. The substantially opaque film of dispersion imaging film, upon application of energy in an amount sufficient to increase the absorbed energy in the material above a certain critical value, is capable of changing to a substantially fluid state in which the surface tension of the material acts to cause the substantially opaque film, where subject to said energy, to disperse and change to a discontinuous film comprising openings and deformed material which are frozen in place following the application of said energy and through which openings light can pass. As used herein, the term "substantially fluid state" means a state wherein the material can move or flow and be deformed by the surface tension of the material and which can have in such state various degrees of fluidity or viscosity depending upon the nature of the material and the temperatures thereof. The terms "dispersion" and "disperse" mean the changing of the solid film of material to the discontinuous film comprising openings and deformed material by surface tension of the material while in the substantially fluid state.

When the film of dispersion imaging material is changed to the substantially fluid state by the application of energy above the certain critical value, the surface tension of the material causes the dispersion imaging material in the film to deform and produce openings in the film. In this deformation of the dispersion imaging material in the substantially fluid state, the deformed material normally, without control, as in the aforementioned applications, continues to roll back substantially instantaneously from the initial openings into small spaced globules with free space therebetween providing mimimal deformed material area and maximal free space area in the discontinuous film which are frozen in place following the application of the energy. This substantially instantaneous and full change of the film of dispersion imaging material to such discontinuous film provides high contrast imaging as distinguished from continuous tone imaging.

To obtain continuous tone or gray scale imaging in accordance with this invention, means are associated with the film of dispersion imaging material for retarding the change to the discontinuous film, caused by the surface tension, and for controlling the amount of such change in accordance with the intensity of the applied energy above said certain critical value to increase the amount of said change and the area of the openings in the film and decrease the area of the deformed material in the film and, therefore, the optical density of the film in accordance with the intensity of the applied energy above said critical value for providing continuous tone or gray scale imaging of the dry-process imaging film. In this respect, the retarding and controlling means associated with the film of dispersion imaging material retards the roll back of the deformed material from the initial openings in the film and controls the amount of such roll back of the deformed material in accordance with the intensity of the applied energy above said certain critical value.

When the intensity of the applied energy is below a certain critical value, no dispersion or change in optical density takes place in the film of dispersion imaging film which is a factor in producing archival properties in the film. When the intensity of the applied energy is just above the certain critical value, the dispersion imaging material in the film is deformed a small amount to provide small area openings in the film, there being only a small amount of roll back of the deformed material from the openings. As a result, the area of the substantially opaque deformed material is extremely large while the area of the openings is extremely small. The transmissivity of the film is low but more than that of the substantially opaque undispersed film. Thus, the optical density of the film, where subjected to such application of energy, is decreased a small amount.

When the intensity of the applied energy is increased a further amount, there is an increased amount of change and of roll back of the deformed material from the openings. As a result, the area of the substantially opaque deformed material is decreased while the area of the openings is increased. The transmissivity of the film is increased, and, thus, the optical density of the film, where subjected to the applied energy of such increased intensity, is decreased an additional amount. Further increases in intensity of the applied energy above said certain critical value provide corresponding decreases in optical density in the discontinuous film, the area of the deformed material therein being correspondingly decreased and the area of the openings therein being correspondingly increased. When the intensity of the applied energy is increased to a maximum, the deformed material is reduced in area to small spaced globules with the area of the openings increasing to form free space between the globules to provide a minimum optical density in the film where subject to such applied energy of maximum intensity.

Thus, in accordance with this invention, the application of energy of different intensities above a certain critical value to the substantially opaque film of dispersion imaging material provides different amounts of dispersion or change to the discontinuous film and, hence, different values of optical density for continuous tone or gray scale imaging.

Basically, in accordance with an operating mechanism here involved, the continuous tone or gray scale imaging is determined by the amount of edge roll back of the deformed material of the film in its substantially fluid state from the openings produced therein in accordance with the intensity of the applied energy.

In one case of the operating mechanism, the amount of edge roll back of the deformed material in accordance with the intensity of the applied energy may be determined and stopped while the deformed material is in its substantially fluid state, and this may be substantially regardless of the length of time of application of the applied energy. Here, a substantially equilibrium condition may be reached in the substantially fluid material whereby the edge roll back is retarded and stopped while the deformed material is still in its substantially fluid state and frozen in place upon subsequent solidification of the deformed material. The energy may be applied in a short pulse, if desired.

In another case of the operating mechanism, the amount of edge roll back of the deformed material in accordance with the intensity of the applied energy may be determined by the solidifying rate of the deformed material from its substantially fluid state to its solid state following the application of applied energy and the roll back velocity of the deformed material in its substantially fluid state while it is cooling to its solid state following the application of the applied energy. Here, a substantially kinetic condition may be involved in the substantially fluid material whereby the edge rollback is retarded and is stopped when the deformed material is solidified and frozen in place. Here, the energy is preferably applied in a short pulse. While these different cases of the operating mechanism are herein set forth for purposes of explanation, they may be both involved in obtaining continuous tone or gray scale imaging in accordance with this invention wherein the change to the discontinuous film, caused by the surface tension, is retarded and wherein the amount of such change is controlled in accordance with the intensity of the applied energy above the certain critical value.

Following the application of the energy the solidification rate may be dependent upon the roll back point density of the film of the dispersion imaging material wherein there are provided roll back points toward which the deformed material in the film in its substantially fluid state moves or rolls back from the openings formed in the film. As compared to the high contrast imaging film of dispersion imaging material as disclosed in the aforementioned applications, the roll back point density is relatively high, there being a relatively large number of roll back points per unit area of the film and, hence, relatively small volumes of deformed material in the fluid state between the openings in the film to be further deformed and rolled back toward the roll back points. Because of the relatively small volumes of the deformed material in the substantially fluid state, the solidification rate from the fluid state to the solid state following the application of the energy, may be more rapid than that of the high contrast dispersion imaging films of the aforementioned applications having a relatively low roll back point density and relatively large volumes of deformed material. In the latter case of the operating mechanism, where the roll back is stopped when the substantially fluid material is solidified to the solid state, the relatively rapid solidification rate makes it possible to stop and freeze the roll back of the deformed material, due to the surface tension of the deformed material in the fluid state, before the roll back is completely accomplished, to provide only a partial roll back and, hence, only a partial dispersion or change of the film toward the discontinuous film.

The roll back point density and, hence, the volumes of the deformed dispersion imaging material in the substantially fluid state and the solidifcation rate are controlled by design parameters involved in the making of the continuous tone or gray scale dry process imaging film of this invention. In this respect, the surface of the substrate may have an uneveness or surface condition which provides roll back points for the dispersion imaging material of the film in its substantially fluid state toward which the substantially fluid material rolls back from openings formed in the film. Such roll back points can also provide nucleation points over which the dispersion imaging material can be preferentially vacuum deposited in substantially vertically arranged columnar grains with substantially vertically arranged grain boundaries therebetween. Here, the film of dispersion imaging material, in its fluid state, preferably breaks up and forms openings adjacent the grain boundaries and rolls back toward the roll back points. Roll back points can also be provided in the film of dispersion imaging material itself in lieu of or in addition to the roll back points at the surface of the substrate.

The solidifying rate can also be controlled by controlling the bulk film structure and mass mobility of the dispersion imaging material in its substantially fluid state. A pure homogeneous dispersion imaging material in cooling from its substantially fluid state to its solid state may well be supercooled below the solidification temperature before it reaches its solid state, thereby allowing additional time for roll back of the material before it becomes solidified. By providing the dispersion imaging material in its substantially fluid state with solids, impurities or the like to make it microheterogeneous, such supercooling is largely eliminated so that cooling or quenching or solidifying of the substantially fluid material to the solid state is brought about directly and most rapidly. Such solids, impurities or the like, in addition to speeding up solidfication to the solid state also operate to reduce the mass mobility and retard the amount of edge roll back of the deformed material in its substantially fluid state from the openings in the film. Such a microheterogeneous film of dispersion imaging material may comprise multiple components and phase boundaries therebetween prior to the actual dispersion thereof. The microheterogeneous film can have areas having a distribution of critical energy sensitivites. In this case the numbers and/or size of the initial small openings in the film will change in proportion to the applied energy.

With respect to the microheterogeneous film of dispersion imaging material having multiple components and phase boundaries therebetween, in a first case, the film may be made heterogeneous during the deposition thereof on the substrate or during the treatment thereof following the deposition, or, in a second case, it may be initially homogeneous and made heterogeneous upon the application of the energy while the material of the film is being heated by the absorption of energy to the certain critical value where it assumes its substantially fluid state and actually begins to disperse toward the discontinuous film. In the second case, the film may be a homogeneous material or the like which breaks down and separates into heterogeneous multiple components having phase boundaries therebetween before the film is heated to the certain critical temperature for forming the substantially fluid state where dispersion of the film begins to take place. The first case, where the film of dispersion imaging material is initially made heterogeneous with multiple components and phase boundaries therebetween during the deposition and/or treatment thereof, is preferred since it appears to offer more control over the solidifying rate, the edge roll back velocity, the amount of edge roll back and the continuous tone or gray scale characteristics of the imaging film. In such first case, an alloy of material having multiple components may be deposited by vacuum deposition or the like on a substrate in the form of a microheterogeneous film having multiple components and phase boundaries therebetween.

Also, in the first case, the substantially opaque film of dispersion imaging material may be deposited on the substrate by vacuum deposition procedures or the like having parameters which provide a grain structure in the film having grains which are substantially vertically oriented with respect to the substrate with substantially vertically oriented grain boundaries therebetween and, preferably, with the grains being determined by and overlying or encompassing the nucleation points referred to above and being relatively small in width. Also, preferably, the outer surfaces of the grains are substantially dome shaped to provide the film of dispersion imaging material with an uneven or rough outer surface. Further, the film of dispersion imaging material is preferably microheterogeneous, having multiple components wherein the grain boundaries between the grains and the outer dome shaped surfaces of grains have a component different from that of the grains themselves to provide phase boundaries therebetween.

The grains of the deposited film of dispersion imaging material may be subjected, either during deposition or thereafter, to an atmosphere having a component different from that of the grains for providing the grain boundaries and the outer surfaces of the grains with a different component from that of the grain. As an example, the deposited film may be subjected to an atmosphere containing oxygen, iodine, sulfur or the like to provide grain boundaries and the outer surfaces of the grains containing oxides, iodides, sulfides or the like. The deposited film may be heat annealed, if desired, to assure diffusion of the oxygen, iodine, sulfur or the like into the grain boundaries of the film.

Further, in such first case, the substantially opaque film of dispersion imaging material may be deposited on the substrate by vacuum deposition procedures or the like in multiple deposition steps to provide a microheterogeneous multiple layer structure including alternate layers of a dispersion imaging material and of a material having components different from that of the dispersion imaging material to provide phase boundaries therebetween which are oriented substantially parallel with respect to the substrate.

The substantially opaque film of dispersion imaging material may be a vacuum deposited alloy, having an eutectic in its system, of a plurality of substantially mutually insoluble solid components having an excess of at least one of the components so that the alloy is off the eutectic of the alloy system. Said at least one of the solid components of the alloy, in the substantially fluid state of the alloy above the eutectic temperature, operates to retard and control the amount of roll back of the film in accordance with the intensity of the applied energy and the phase boundaries existing between the components of the alloy. Such an alloy, having an eutectic in its system, is particularly suitable for this invention since it has a relatively low eutectic melting temperature and can be made substantially fluid with relatively low intensities of applied energy and, hence, have relatively high sensitivity. This feature of high sensitivity is also an important aspect of this invention.

The control of the amount of edge roll back is determined by the microheterogeneous nature of the film of dispersion imaging material and the phase boundaries therein, as referred to above, and/or by the interfacial adhesion between the film of dispersion imaging material and the substrate and/or the overcoat film.

The phase boundaries in the film of dispersion imaging material, in addition to increasing the solidification rate of the material in the substantially fluid state to the solid state, also decrease the mass mobility and, hence, the amount of roll back of the material in the substantially fluid state from the openings in the film, the phase boundaries acting as deterrents or impediments to such roll back of the material. The phase boundaries in the material of the film must be changed or broken up and also carried along with the material in its substantially fluid state as it is being rolled back by the surface tension of the material in its substantially fluid state, which operates to decrease the mass mobility and retard the amount of edge roll back of the material and the change to the discontinuous film.

The film of dispersion imaging material deposited on the substrate results in interfacial adhesion therebetween which opposes, as for example, by wetting or friction or the like, the surface tension force of the material in its substantially fluid state to roll back the material and, thus, also decreases the edge roll back velocity and the amount of roll back and retards the change of the material to the discontinuous film. This interfacial adhesion may be enhanced by heat annealing the imaging film. However, the interfacial adhesion is never so great as to prevent the surface tension force of the material in its fluid state from rolling back the material.

As expressed above, the film of dispersion imaging material deposited on the substrate preferably has an overcoat film deposited thereover which also results in interfacial adhesion therebetween which also opposes, as for example, by wetting or friction or the like the surface tension force of the material in its substantially fluid state to roll back the material. This interfacial adhesion between the dispersion imaging material and the overcoat film, in addition to having an effect upon the roll back point density, also decreases the edge roll back velocity and the amount of roll back and retards the change of the material to the discontinuous film. This interfacial adhesion is particularly effective for controlling the roll back where the outer surface of the film of dispersion imaging material is uneven or rough, as for example, where the film comprises substantially vertically oriented grains having exposed dome shaped ends forming the outer surface of the film. The overcoat film, as it is deposited on the outer surface of the film of dispersion imaging material, follows the contour of the latter and provides effective retarding of the change of the material to the discontinuous film. This interfacial adhesion may be enhanced by heat annealing the imaging film, which results in the overcoat film following more closely the contour of the outer surface of the film of imaging material. Here, also, this interfacial adhesion is never so great as to prevent the surface tension from rolling back the material.

When the film of dispersion imaging material is subjected to energy in an amount sufficient to increase the absorbed energy in the material to above the certain critical energy value, the material assumes a substantially fluid state in which the surface tension of the material acts to cause the film to disperse and change to a discontinuous film comprising openings and deformed material which are frozen in place following the application of said energy. The greater the intensity of the applied energy, the higher becomes the temperature of the material in its substantially fluid state and the greater the amount of the roll back of the deformed material and the greater the amount of the dispersion or change of the material to the discontinuous film comprising openings and deformed material which are frozen in place. In said one case of the operating mechanism referred to above, which, for example, can include an alloy having a eutectic in its system, the amount of the solid component in the substantially fluid material decreases as the temperature of the alloy is increased above the eutectic temperature thereof and, therefore, provides less resistance or impediment to the roll back of the substantially fluid material at higher temperatures than at lower temperatures. Thus, for higher temperatures there will be more rollback of the substantially fluid material than for lower temperatures and, hence, more roll back for higher intensities of the applied energy than for lower intensities thereof. The amount of dispersion or change to the discontinuous film, i.e., from no dispersion or change to full dispersion or change and degrees of partial dispersion or change therebetween is thereby readily controlled.

In said other case of the operating mechanism referred to above, where the amount of roll back of the substantially fluid material is dependent upon the roll back velocity of the fluid material while it is being cooled to its solid state, the higher the temperature of the substantially fluid material, the longer it takes to cool or quench or solidify and the more the amount of rollback until it is frozen into its solid state. The temperatures of the substantially fluid material from which it cools and solidfies following the application of the energy are dependent upon the intensities of the applied energy. The energy is preferably applied in a short pulse. Since the cooling or quenching or solidfication of the film of dispersion imaging material from its substantially fluid state to its solid state is made to occur rapidly and since the dispersion or change of the material to the discontinuous film is retarded, all as expressed above, the amount of such dispersion or change to the discontinuous film is readily controlled in accordance with the intensity of the energy pulse above the aforementioned certain critical value to provide desired amounts of dispersion or change of the material to the discontinuous film, i.e., from no dispersion or change below the certain critical value to full dispersion or change and degrees of partial dispersion or change therebetween above the certain critical value.

The aforementioned considerations concerning the interfacial adhesion between film of dispersion imaging material and the substrate and overcoat film, the solidification rate and the control of the edge roll back velocity and the amount of edge rollback of the material in its substantially fluid state, and the intensity of the applied energy above the certain critical value, jointly and severally constitute means associated with the film of dispersion imaging material for retarding the change to the discontinuous film, caused by the surface tension, and for controlling the amount of such change in accordance with the intensity of the applied energy above the certain critical value to increase the amount of said change and the area of the openings in the film and decrease the area of the deformed material in the film and, therefore, the optical density of the film in accordance with the intensity of the applied energy above said certain critical value for providing continuous tone or gray scale imaging of the dry process imaging film.

The method of this invention for producing by a dry process a continuous tone or gray scale image comprises the step of providing a continuous tone dry process imaging film including a substrate, a solid, high optical density and substantially opaque film of dispersion imaging material deposited on the substrate and, preferably, an overcoat film deposited thereon, all as described above, and the step of applying to said substantially opaque film of dispersion imaging material energy in an amount sufficient to increase the absorbed energy in the material above a certain critical value to disperse and change the same, where subjected to said applied energy, to a discontinuous film comprising openings and deformed material which are frozen in place following application of said energy and through which openings light can pass, and controlling the intensity of the applied energy above said certain critical value to control the amount of such change in accordance with the intensity of the applied energy above said certian critical value to increase the amount of said change and the area of the openings in the film and decrease the area of the deformed material in the film and, therefore, the optical density of the film in accordance with the intensity of the applied energy above said certain critical value for continuous tone imaging of the dry process imaging film. By subjecting various areas of the dry process imaging film to different intensities of the applied energy above the certain critical value, the optical densities of the film in those various areas will be changed in accordance with the particular intensities of the applied energy to which they are respectively subjected and, thus, provide continuous tone or gray scale imaging of the film.

The energy may comprise various forms of energy. The energy may comprise Joule heat energy applied to the film by means of, for example, direct electrical heating, electrically energized heating means, or the like, and absorbed in the film. The intensity of the applied Joule heat energy above the certain critical value determines the amount of dispersion or change of the film to the discontinuous film for continuous tone imaging, as discussed above. The heating means may include a single heating point which serially scans the film and which is intensity modulated, for full format imaging of the film. In both cases continuous or it may comprise an advanceable matrix of heating points which are intensity modulated, tone imaging is obtained. The applied energy may also comprise a beam of radiant energy, such as, a laser beam of coherent energy or the like, which serially scans the film and which is intensity modulated for determining the amount of dispersion or change to the discontinuous film and providing continuous tone or gray scale imaging.

This applied energy may also be noncoherent radiant energy, afforded by, for example, a Xenon lamp or flash bulb or the like, which is applied through an imaging mask, having a full format continuous tone imaging pattern including portions of continuously differing transmissivity for the applied energy, to the substantially opaque film of dispersion imaging material substantially evenly in a full format pattern corresponding to the full format continuous tone imaging pattern of the imaging mask and having areas of different intensities of the applied energy above the certain critical value to provide at one time in the substantially opaque film of dispersion imaging material a stable finished full format image pattern of discontinuous film corresponding to the full format continuous tone pattern of the applied energy. In this instance the energy is preferably applied as a short pulse of said energy.

This latter manner of continuous tone or gray scale imaging is particularly applicable to and has great significance in several respects in the dry-process apparatus for producing archival microform records from light reflecting hard copy, as disclosed in the aforesaid application Ser. No. 458,715, now U.S. Pat. No. 3,966,317, wherein the light reflecting hard copy is microimaged as a transparency on an intermediate mask film and wherein the microimaged transparency of the mask film is reproduced on the film of dispersion imaging by a short pulse of radiant or electro-magnetic energy.

The high contrast film of dispersion imaging material, as disclosed in the aforementioned application, can be full format imaged with fine contrast and line resolution in the apparatus of said application Ser. No. 458,715 when the hard copy is uniformly illuminated, the lens system is capable of reducing the image from the uniformly illuminated hard copy and applying the same to the intermediate mask film in a uniform manner with uniform contrast and line resolution, and the mask film is capable of producing a faithful reduced transparency of the uniformly illuminated hard copy with appropriate optical density and uniform contrast and line resolution. However, where the contrast and its uniformity in the mask film transparencies decreases, the line resolution thereof also decreases and the faithfulness of the reproduction of the image in the film of dispersion imaging material likewise decreases. A decrease in contrast and its uniformity, in addition to being caused by a reduction of the image, can also be caused by a sub-perfect illumination, by a sub-perfect lens system and by a sub-perfect intermediate mask film, any of which can cause an inferior image reproduction in the film of dispersion imaging material. In full format imaging various portions of the mask film transparency may have different amounts of contrast and optical density than other portions which also results in uneven imaging of the film of dispersion imaging material. In addition, nonuniformity of the flashing intensities over the full format area for the image transfer decreases the faithfulness of the reproduction in some of the cases.

Utilizing the continuous tone imaging film of this invention in the apparatus of said application Ser. No. 458,715, now U.S. Pat. No. 3,966,,317, obviates the aforementioned problems and provides latitude for such apparatus, allowing for greater tolerances in the lighting, lens system, intermediate mask film and flashing system thereof, to provide faithful reproduction of microimages of the hard copy in the continuous tone imaging film. The continuous tone imaging film of this invention has a relatively low gamma with respect to the relatively high gamma of the high contrast films of the aforementioned applications so as to be less affected by variations in contrast and optical density of the mask film and, hence, provide better line resolution in the film of dispersion imaging material, the former having the relatively low gamma providing wider latitude for the intensity of the short pulse of energy than the latter. The continuous tone imaging film of this invention is also capable of accurately reproducing continuous tone images of the hard copy, such as, photographs or the like, as well as printed material, line drawings or the like. Where the imaging film comprising an alloy, having an eutectic in its system, to provide high sensitivity is utilized, smaller intensities of energy may be applied to the imaging film for imaging purposes.

Further objects of this invention reside in the construction of the continuous tone dry process imaging film and in the cooperative relationships between the component parts thereof, and in the methods of making such an imaging film and of making a continuous tone image utilizing such imaging film and in the cooperative relationships between the steps of said methods.

Other objects and advantages of this invention will become apparent to those skilled in the art upon reference to the accompanying speicification, claims and drawings, in which:

Figure 1:
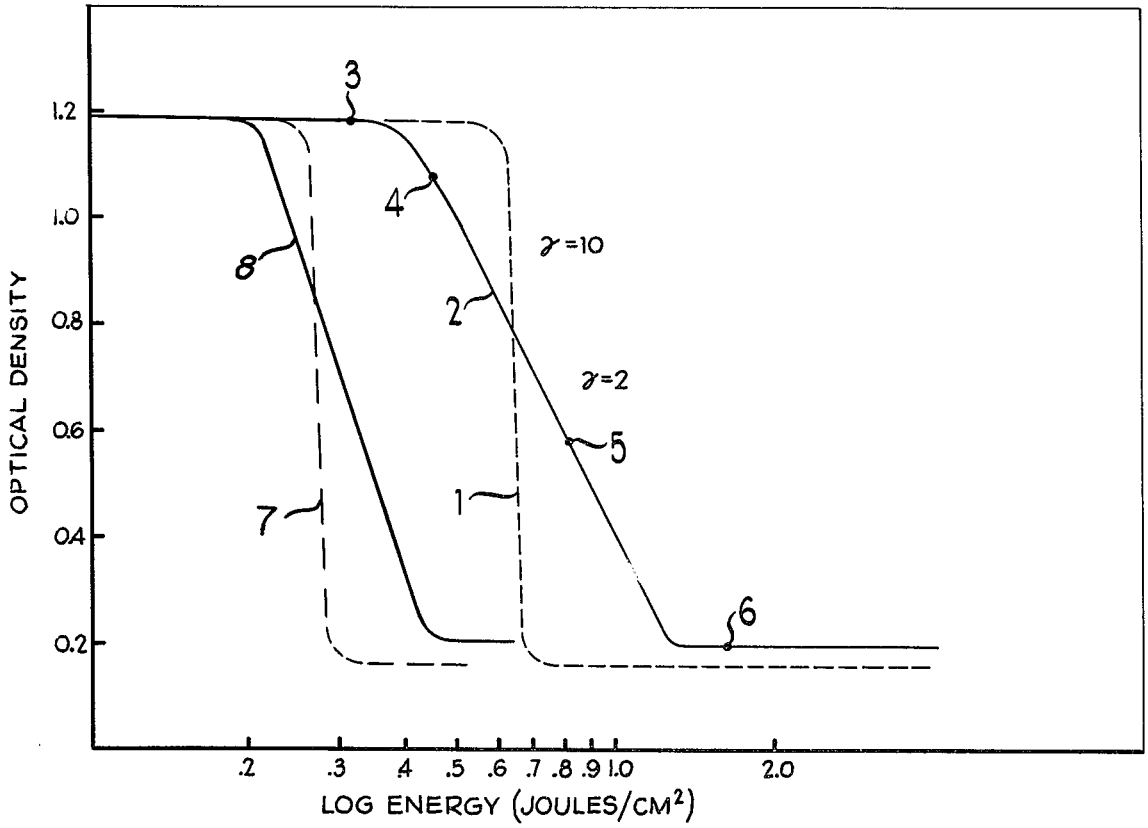
FIG. 1 is a typical graph plotting optical density vs. log energy for the high contrast dispersion imaging film referred to above and for the continuous tone dispersion imaging film of the instant invention.

In FIG. 1 the optical density is plotted against log energy (joules/cm$^2$) for typical dispersion imaging films. Curve 1 in dotted lines illustrates the optical density vs. log energy characteristics of the high contrast imaging film referred to above. When the intensity of the applied, absorbed energy is below a threshold value of substantially 0.63 joules/cm$^2$, no imaging takes place and the optical density of the film remains high at approximately 1.2. For applied energy intensities above said threshold value of substantially 6.3, maximum dispersion substantially immediately occurs so as to provide a low optical density of approximately 0.2. Thus, in the high contrast imaging film the optical density remains high at 1.2 and the film is substantially opaque when the intensity of the applied energy is less than said threshold value of substantially 0.63 and, when the intensity of the applied energy is greater than said threshold value of substantially 0.63, the optical density immediately decreases to substantially 0.2 and is substantially transparent.

The curve 2 in FIG. 1 sets forth optical density vs. log energy characteristics of a typical continuous tone imaging film of the instant invention. The continuous tone imaging film does not have a sharp threshold energy value as in the high contrast imaging film but, instead, has a certain critical energy value, as for example, about 0.35 joules/cm$^2$, where imaging can begin to take place. When the intensity of the applied energy is below the critical value, as at point 3 on curve 2, no imaging takes place and the optical density remains at substantially 1.2. When the intensity of the applied energy is above the critical value, as at point 4 on curve 2, a small amount of dispersion of the imaging material takes place and the optical density is decreased to substantially 1.1. When the intensity of the applied energy is increased further above the critical value, as indicated at point 5 on curve 2, more dispersion of the imaging material takes place to provide an optical density of substantially 0.6. When the intensity of the applied energy is further increased, as illustrated at point 6 on curve 2, substantially maximum dispersion of the imaging material takes place to provide an optical density of substantially 0.2. Accordingly, in the continuous tone imaging film of the instant invention, various degrees of optical density are obtained by the application of various amounts or intensities of energy to the film above said certain critical value. The gamma of the curve 1 for the high contrast imaging film is substantially 10 while that of curve 2 for the continuous tone imaging film is substantially 2. The points 3, 4, 5, and 6 correspond to the conditions of the continuous tone imaging film as diagrammatically illustrated in FIGS. 3, 4, 5, and 6 and as microphotographically illustrated in FIGS. 7, 8, 9, and 10.

In FIGS. 3–6 the continuous tone imaging film of the instant invention is generally designated at 9. It includes a substrate 10 which is preferably transparent and while it may be formed from substantially any substrate material, it is preferably formed from a polyester material, such as a polyester terephthalate, known as Melinex type O microfilm grade, manufactured and sold by ICI of America. The thickness of the substrate 10 is preferably in the range of about 4–7 mils.

Deposited on the substrate 10, as by vacuum deposition or the like, is a thin film of dispersion imaging material 11 which may comprise many different types of materials as will be discussed below. The thickness of the film of dispersion imaging material is such as to provide an optical density of about 1.2 in the completed imaging film. Generally the thickness will run around about 500 A to about 1500 A.

Figure 2:
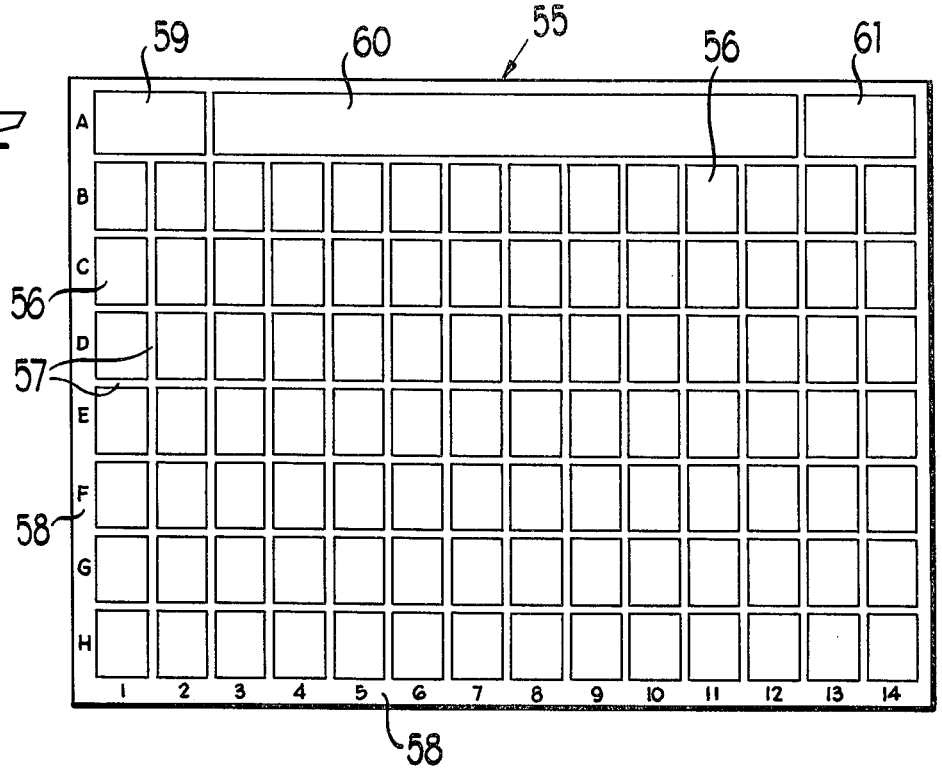
FIG. 2 is a plan view of a fully formatted fiche card utilizing the features of this invention.

Deposited over the film 11 of dispersion imaging material is a substantially transparent overcoat film having a thickness range of 0.1 to 3 and preferably about 0.8 microns and preferably formed of a suitable polymer resin. For a nonformatted film the overcoat film may comprise a polymer resin coating, for example, polyurethane Estane No. 5715 as manufactured and sold by B.F. Goodrich Company, or silicone resin, Dow Corning R-4-3117 as manufactured and sold by Dow Corning Company, or polyvinylidine chloride (Suran) as manufactured and sold by Dow Chemical Company, or an inorganic coating, such as silicon dioxide ($SiO_2$). For a formatted film as illustrated in FIG. 2 the overcoat film may comprise a photoresist material such as polyvinylcinnamate, for example, a Kodak KPR-4 photoresist manufactured and sold by Eastman Kodak Company which is negative working. The overcoat film may be applied by spin coating, roller coating, spraying vacuum deposition or the like.

The continuous tone imaging film including the substrate 10, the film 11 of dispersion imaging material and the polymer overcoat 12 may be imaged by energy, such as, for example, noncoherent radiant energy form a Xenon lamp or flash bulb or the like through an imaging mask 13, as illustrated in FIGS. 3 to 6. The imaging mask 13 controls the amount of noncoherent radiant energy passing therethrough and the amount of energy absorbed in the film 11 of dispersion imaging material and, therefore, controls the amount of dispersion of the dispersion imaging material and the optical density thereof where imaged.

Figure 3:
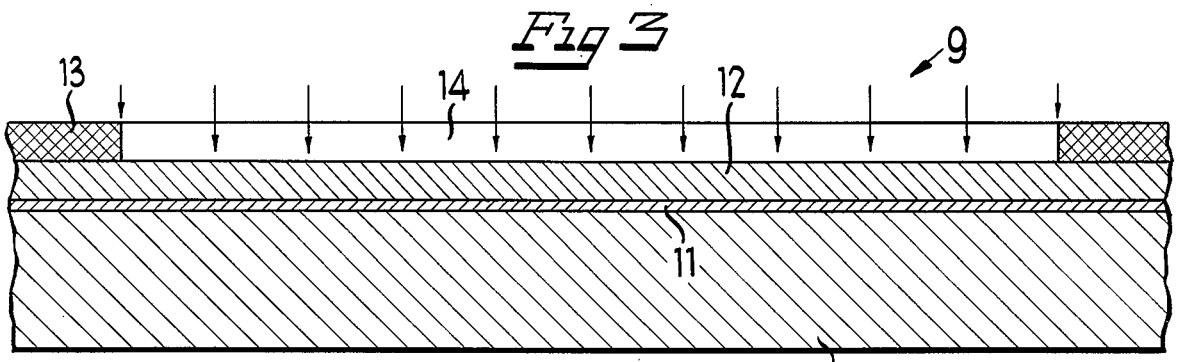
FIG. 3 is a greatly enlarged sectional view through the imaging film of this invention and illustrating the imaging film before it is imaged.

In FIG. 3, the portion 14 of the imaging mask 13 has a sufficiently high optical density to limit the amount of intensity of the energy, as shown by the arrows, applied therethrough to the film 11 of dispersion imaging material so that the absorbed energy in the material is not increased above the aforesaid certain critical value. As a result, the material is not changed to a substantially fluid state and the film 11 of dispersion imaging material remains in its solid, high optical density and substantially opaque condition. This condition, in addition to being illustrated in FIG. 3, is designated at point 3 on curve 2 in FIG. 1, and is disclosed microphotographically in FIG. 7. There are no openings in the imaging film 11 in FIGS. 3 or 7 through which light can pass, the film being substantially opaque and having an optical density of substantially 1.2.

Figure 4:
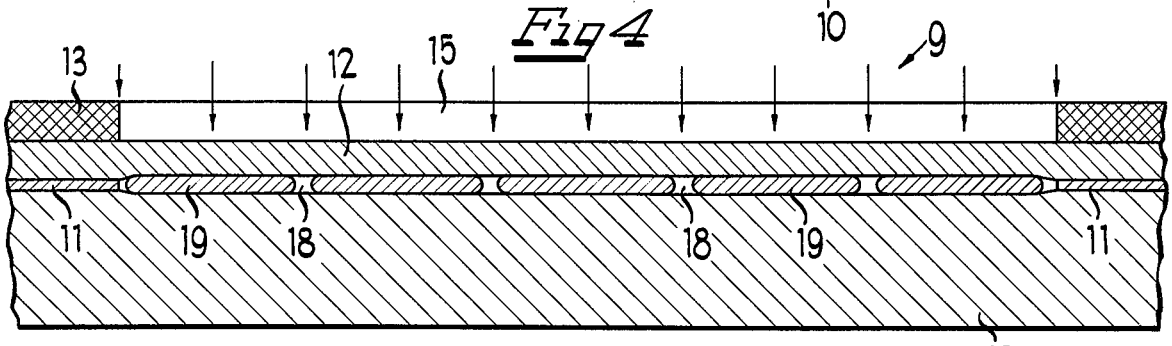
FIG. 4 is a sectional view similar to FIG. 3 and illustrating the imaging film when it is imaged by the application of relatively low energy above a critical value and having a relatively high optical density.

In FIG. 4, the portion 15 of the imaging mask 13 has a lower optical density to allow more radiant energy, as shown by the arrows, pass therethrough and be applied to the film 11 of dispersion imaging material. Here, the intensity of the applied energy is such that the absorbed energy in the film is just above the aforesaid certain critical value as designated at point 4 in curve 2 of FIG. 1. The film 11 of dispersion imaging material is changed by such energy to a substantially fluid state in which the surface tension of the material causes the material to disperse and change to a discontinuous film having openings 18 and deformed material 19 which are frozen in place following said application of energy and through which openings 18 light can pass. The dispersion imaging material is deformed only a small amount as indicated at 19 to provide only small area openings 18 in the film 11, there being only a small amount of roll back of the deformed material 19 from the openings 18. The transmissivity of the film is low but more than that of the substantially opaque undispersed film of FIGS. 3 and 7. Thus, the optical density of the film, where subject to such application of energy, is decreased a small amount to provide an optical density of substantially 1.1 as shown by point 4 of the curve 2 in FIG. 1. The light portions in the microphotograph of FIG. 8 constitute transmitted light and the openings 18 in the otherwise dark and substantially opaque film 11. The area of the substantially opaque deformed material 19 is extremely large while the area of the openings 18 is extremely small, accounting for the aforementioned optical density of substantially 1.1.

Figure 5:
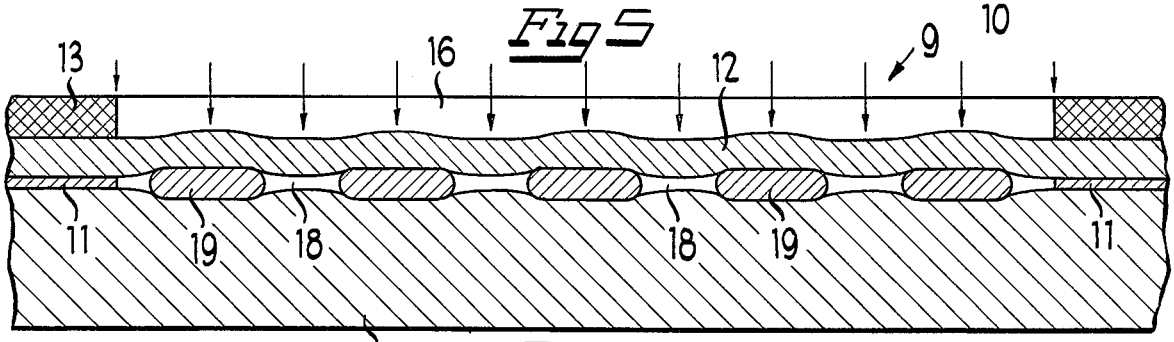
FIG. 5 is a sectional view similar to FIGS. 3 and 4 and illustrating the imaged film when it has been subject to a greater amount of energy above the critical value and having a lower optical density.
Figure 9:
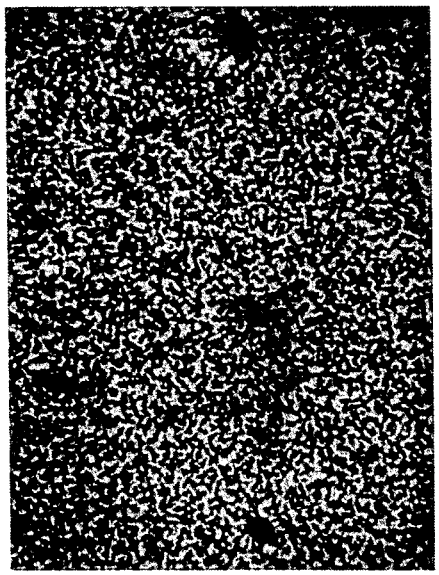
Figure 10:
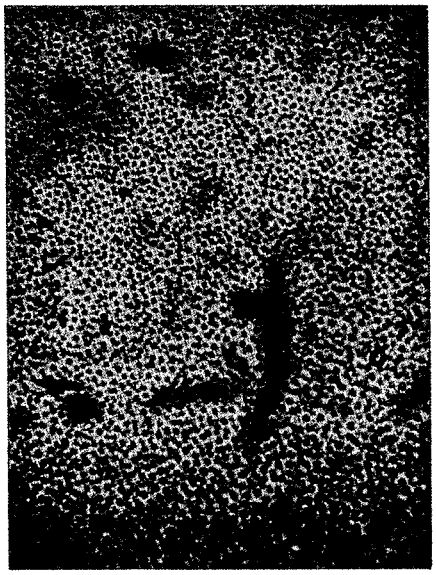

In FIG. 5, the portion 16 of the imaging mask 13 has a lower optical density to allow still more radiant energy, as shown by the arrows, to pass therethrough and be applied to the film 11 of dispersion imaging material. Here, the intensity of the applied energy is such that the absorbed energy in the film is considerably above the aforesaid certain critical value as designated at point 5 in curve 2 of FIG. 1. Because of the increased intensity of the applied energy the dispersion imaging material is deformed a greater extent as indicated at 19 to provide larger area openings 18 in the film 11, there being a larger amount of roll back of the deformed material 19 from the openings 18. The transmissivity of the film is thus increased and the optical density thereof decreased a greater amount to provide an optical density of substantially 0.6 as shown by point 5 in the curve 2 of FIG. 1. The light portions in the microphotograph of FIG. 9 constitute transmitted light and the openings 18 in the film and the dark portions constitute the substantially opaque deformed portions 19 in the film. Such increase in the area of the openings 18 and decrease in the area of the deformed material, as seen in FIG. 9 account for the aforementioned decreased optical density of substantially 0.6.

Figure 6:
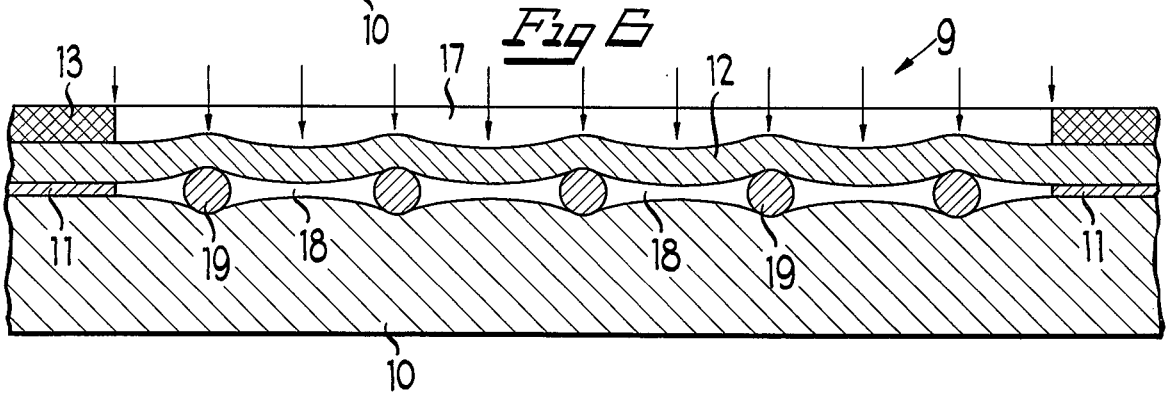
FIG. 6 is a sectional view similar to FIGS. 3, 4 and 5 and illustrating the imaged film when subjected to a still greater amount of energy and having a minimum optical density.
Figure 7:
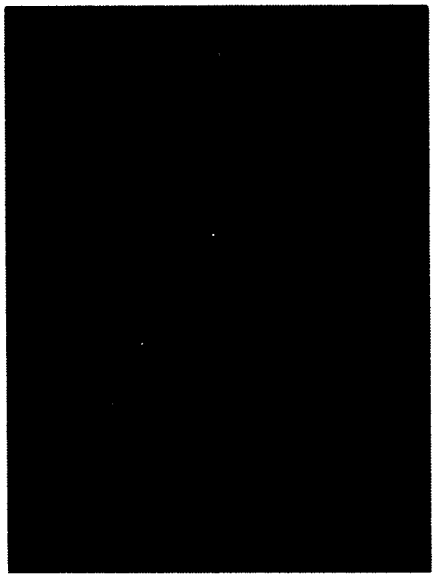
FIGS. 7, 8, 9 and 10 are microphotographs, as viewed in transmission, of the continuous tone imaging film of this invention, corresponding, respectively, to the sectional views of FIGS. 3, 4, 5 and 6, the microphotographs being taken substantially at 800*x* magnification.
Figure 8:
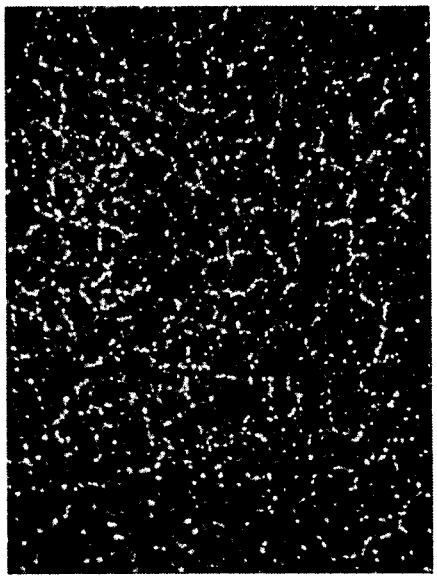

In FIG. 6, the portion 17 of the imaging mask 13 has a still lesser optical density to allow still more radiant energy, as shown by the arrows, to pass therethrough and be applied to the film 11 of dispersion imaging material. Here, the intensity of the applied energy is such that the absorbed energy in the film is still more above the aforesaid certain critical value, substantially a maximum value, as designated at point 6 in curve 2 of FIG. 1. Because of this further increased intensity of the applied energy the dispersion imaging material is deformed a greater extent to small spaced globules 19 and the openings 18 are increased to form substantially free space between the globules, there being a larger roll back of the deformed material 19 from the openings 18. The transmissivity of the film is thus increased to a maximum and the optical density thereof decreased to a minimum to provide an optical density of substantially .2 as shown by point 6 of curve 2 of FIG. 1. The dark portions of the microphotograph of FIG. 10 constitute the substantially opaque deformed portions 19 of the dispersion imaging material which are substantially globular and the light -ortions thereof constitute transmitted light and the openings 18 in the film which comprise substantially free space between the spaced globules.

The openings 18 and deformed material 19 visible in the 800x magnified microphotographs of FIGS. 7 to 10 are not visible to the human eye or in microfilm readers or the like having a magnification of 24*x* or 48*x*. In the undispersed condition of FIG. 7 where the optical density is substantially 1.2, the film 11 appears substantially opaque and black for transmitted light, and in the fully dispersed condition of FIG. 10 where the optical density is substantially 0.2, the film appears substantially transparent and clear and white for transmitted light. For the intermediate conditions between FIGS. 7 and 10, for example, FIGS. 8 and 9, the film appears partially transparent and different shades of gray for transmitted light depending upon the intermediate optical densities thereof. Effective continuous tone or gray scale imaging by a dry process is here provided.

To obtain continuous tone or gray scale imaging in accordance with this invention, means are associated with the film 11 of dispersion imaging material for retarding the change to the discontinuous film, caused by the surface tension, and for controlling the amount of such change in accordance with the intensity of the applied energy above the aforesaid certain critical value to increase the amount of said change and the area of the openings 18 in the film and decrease the area of the deformed material 19 in the film and, therefore, the optical density of the film in accordance with the intensity of the applied energy above said critical value for providing continuous tone or gray scale imaging of the dry process imaging film. In this respect, the retarding and controlling means associated with the film of dispersion imaging material retards the roll back of the deformed material 19 from the initial openings 18 in the film 11 and controls the amount of such roll back of the deformed material 19 in accordance with the intensity of the applied energy above said certain critical value.

The retarding and controlling means associated with the film 11 of dispersion imaging material may comprise multiple components and phase boundaries in the substantially opaque film 11 of dispersion imaging material prior to dispersion thereof, which oppose the surface tension force of the material in its substantially fluid state, and/or the interfacial adhesion between the film 11 of dispersion imaging material and the substrate 11 and the overcoat film 12 of the dry process imaging film, which also opposes, as for example, by wetting or friction or the like, the surface tension force of the material in its substantially fluid state. These factors involved in the retarding and controlling means, jointly and/or severally, operate effectively to retard the roll back of the deformed material and to control the amoutn of such roll back in accordance with the intensity of the applied energy. Various examples of the continuous tone dry process imaging film including the retarding and controlling means, the methods of making the same, and the methods of imaging the same are set forth below and are illustrated in FIGS. 11 to 14.

Figure 11:
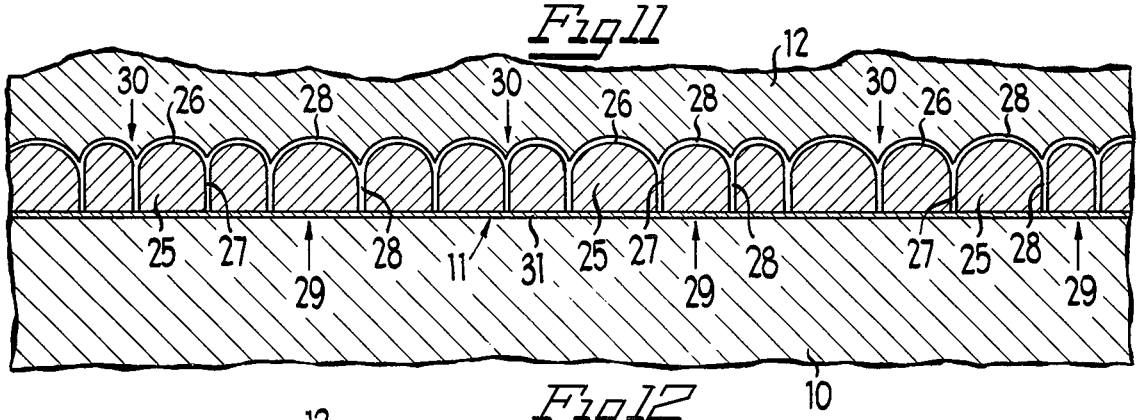
FIG. 11 is a further enlarged stylised sectional view of one form of this invention.

FIG. 11 is a greatly enlarged and stylized sectional view of one form of the continuous tone dry process imaging film of this invention. It comprises the substrate 10 and the overcoat film 12 as discussed above and also the film 11 of dispersion imaging material. The film 11 which is deposited on the substrate 10 includes a plurality of grains 25 which are substantially vertically oriented with respect to the substrate 10 and which have dome shaped ends 26 and substantially vertically oriented grain boundaries 27 between the grains. In this particular embodiment of the invention, the deposited grains 25 are formed of bismuth and the outer surfaces of the grains 25 and the grain boundaries 27 therebetween include bismuth oxide as indicated at 28. Thus, the solid, high optical density and substantially opaque film 11 of dispersion imaging material comprises a microheterogeneous structure having multiple components, including the bismuth grains and the oxide material 28 on the outer surfaces of the grains and in the grain boundaries therebetween, and phase boundaries between such multiple components.

Optionally, the substrate 10 may be provided with a very thin layer, such as an average thickness of about 10 A, of aluminum oxide ($Al_2O_3$) before the grains 25 are deposited thereon. The thin layer 31 of aluminum oxide which is substantially island like in configuration operates to bond the grains 25 in their solid state more firmly to the substrate 10 and, also, to provide in an efficient manner nucleation points for the deposition of the grain 25. The thin layer 31 of aluminum oxide is applied to the substrate 10 by a sputtering process. Here, a roll of the substrate material is placed in a sputtering machine and the substrate material is linearly passed adjacent to a cathode of aluminum oxide in a sputtering atmosphere of argon gas at a pressure of about $4 \times 10^{-3}$ Torr and at a speed to provide the aforementioned layer thickness of about 10 A and rewound on a suitable rewind roll.

The film 11 of dispersion imaging material comprising the grains 25 is deposited on the substrate 10, with or without the aluminum oxide layer 31, by a vacuum deposition procedure. Here, a vacuum deposition machine may be utilized including therein a payoff roll, a takeup roll and a water cooled roll therebetween, the substrate material being payed off the payoff roll under the water cooled roll and taken up on the takeup roll. A resistance heater boat is arranged about 6 inches below the substrate material as it passes under the water cooled roll and contains the dispersion imaging material, such as bismuth, to be vacuum deposited on the substrate material as it passes under the water cooled roll. An optical monitor is arranged adjacent the substrate with the film of dispersion imaging material deposited thereon between the water cooled roll and the takeup roll for monitoring the optical density of the deposited film of dispersion imaging material. The optical density of the film is of principal importance and for an optical density of substantially 1.6 for this film the film thickness would be about 750 A.

The vacuum deposition machine is operated to provide such optical density and, hence, such film thickness. In this connection and as one example, the vacuum in the machine is pumped down to about $5 \times 10^{-6}$ Torr and the temperature of the resistance heater boat is maintained at about 624° C to evaporate the bismuth therein onto the substrate under the water cooled roller. The temperature of the water cooled roller is controlled to maintain the temperature of the substrate engaging the same at about 100° C. The speed of advance of the substrate through the machine is about 7 ft/min and the rate of deposition of the bismuth is about 4,000 A/min. Under such deposition parameters the appropriate optical density and film thickness are obtained and a film structure is obtained having a plurality of substantially vertically oriented grains 25 having dome shaped ends 26 and substantially vertically oriented grain boundaries 27 therebetween, as illustrated in FIG. 11. The grains each include a plurality of crystallites therein.

After such deposition procedure, the substrate 10 with the film 11 deposited thereon is removed in roll form from the take-up roller in the machine and is aged in roll form at ambient room temperature and humidity condition for a time period, as for example, about 3 weeks. Upon such aging, the outer surface of the film 11 including the dome shaped ends 26 of the grains 25 become oxidized and oxygen also diffuses into the grain boundaries 27 between the grains 25 as illustrated in FIG. 11. Such oxidation operates to reduce the optical density of the film to about 1.4.

Thereafter, the polymer resin overcoat film 12, as discussed above, is deposited over the oxidized bismuth film by spin coating, roller coating, spraying or the like and the overcoat film follows quite closely the dome shaped contour of the outer surface of the oxidized film as shown in FIG. 11. Following the deposition of the overcoat film 12, the imaging film, including the substrate 10, the film 11 of dispersion imaging material and the overcoat film 12, is heat treated or annealed to within a temperature range of about 100° C to 180° C for a time interval range of about 15 seconds to 30 minutes, preferably to about 140° C for about 2½ minutes. This can be accomplished by contacting and advancing the imaging film between heated belts carried by and heated by heated rollers, or by placing the imaging film on a hot plate and pressing the same against the hot plate with a suitable cover. This heat treating or annealing of the imaging film causes an increased bonding between the solid film 11 of dispersion imaging material and the substrate 10 and/or overcoat film and softens the overcoat film 12 to cause it to follow still more closely the contour of the outer surface of the film 11. It also causes oxygen to diffuse more deeply into the grain boundaries 27 and substantially down to the substrate 10, as illustrated in FIG. 11. The optical density of the imaging film also reduces to substantially 1.2 as illustrated by the curve 2 in FIG. 1.

When sufficient energy is applied to the imaging film illustrated in FIG. 11 to cause the absorbed energy to increase in the film 11 of dispersion imaging material above the aforementioned critical value, the film 11 is changed to a substantially fluid state wherein the surface tension of the material acts to cause the film where subject to the applied energy to disperse and change to the discontinuous film comprising openings 18 and deformed material 19 as discussed above in connection with FIGS. 3 to 6 and 7 to 10. The openings usually begin to form at some of the phase boundaries between the bismuth grains 25 and the oxides 28 as indicated at 30 in FIG. 11 and the deformed material rolls back toward roll back points as indicated at 29 in FIG. 11.

The oxides 28 and the phase boundaries between the oxides and the grains 25 act as impediments or deterrents to the roll back of the dispersion imaging material in its substantially fluid state under the influence of the surface tension thereof and, therefore, retard the change to the discontinuous film and control the amount of such change in accordance with the intensity of the applied energy. In this respect, the phase boundary energies must be overcome and the oxides, which remain substantially solid, must be broken up and carried along by the substantially fluid material as the material is so rolled back by the surface tension of the material. Also, there is an interfacial adhesion between the film 11 of dispersion imaging material and the substrate 10 and/or the overcoat film 12 which also retards and controls the amount of the roll back fo the dispersion imaging material in its substantially fluid state, this interfacial adhesion, being accentuated by the unevenness or roughness of the outer surface of the film 11 caused by the dome shaped ends 26 of the grains 25.

Figure 12:
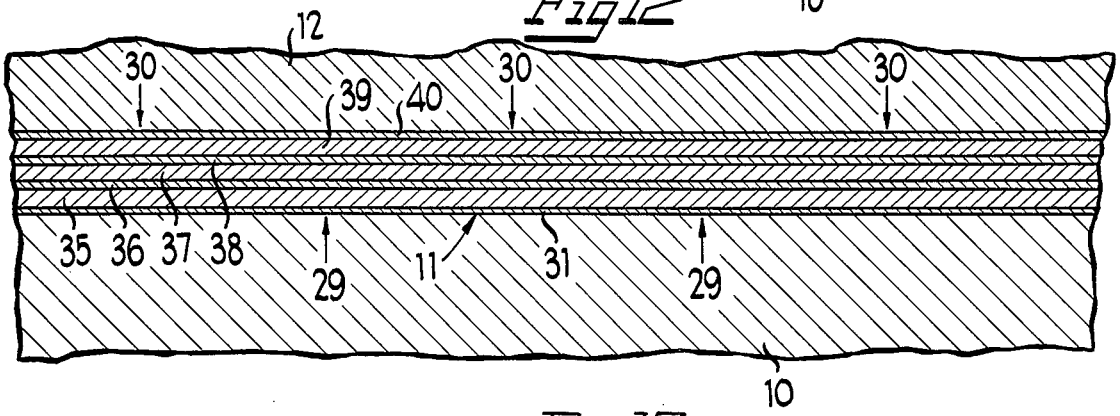
FIG. 12 is an enlarged stylised sectional view similar to FIG. 11 but illustrating another form of the instant invention.

FIG. 12 is a sectional view similar to FIG. 11 but illustrating another form of the continuous tone dry process imaging film of this invention. It comprises the substrate 10 and the overcoat film 12 as discussed above and also the film 11 of dispersion imaging material. The film 11 which is deposited on the substrate 10, optionally with or without the layer 31, includes a plurality of layers of different component materials, which layers are substantially parallelly oriented with respect to the substrate. In this particular embodiment of the invention, the film 11 includes a layer of bismuth 35, an oxide layer 36, a bismuth layer 37, an oxide layer 38, a bismuth layer 39, and an oxide layer 40, thereby providing a microheterogeneous structure.

The film 11 of the dispersion imaging material, comprising the multiple layers 35 to 40, is deposited on the substrate 10, with or without the aluminum oxide layer 31, by a vacuum deposition procedure utilizing a vacuum deposition machine like that described above in connection with the deposition of the dispersion imaging film 11 in connection with FIG. 11. The vacuum deposition machine is pumped down to a vacuum of $10^{-6}$ Torr and the substrate is paid out from the payoff roll overthe water cooled roll to the takeup roll at a speed of about 7 ft/min. and the layer 35 of bismuth is vacuum deposited on the substrate 10 as it courses the water cooled roll. The deposition rate is about 1000 A/min. and the optical density of the layer 35, as monitored by the optical monitor adjacent to the layer 35, is about 0.6. After the layer 35 of bismuth is so deposited and wound on the takeup roll, the machine is back filled with oxygen up to about one atmosphere. The direction of the movement of the film is reversed and the film including the bismuth layer 35 is advanced from the takeup roll to the payout roll at a speed of about 7 ft/min. This provides the oxide layer 36 on the layer 35. When this step is completed, the vacuum deposition machine is again pumped down to the $10^{-6}$ Torr and the first step is repeated by advancing the film from the payout roll to the takeup roll. This provides the layer 37 of bismuth on the oxide layer 36. The machine is then again back filled with oxygen and the direction of the film reversed and the second step above is repeated to provided the bismuth layer 37 with the oxide layer 38. The machine is again pumped down to $10^{-6}$ Torr and the film is advanced from the pay-off roll to the take-up roll for depositing the bismuth layer 39 on the oxide layer 38. The optical density of the film following the foregoing steps, as determined by the optical monitor, is substantially 1.5. The bismuth layers 35, 37, and 39 have a grainy structure with grain boundries therein, perhaps similar to the structure illustrated in FIG. 11. Oxygen diffuses into the grain boundaries probably during the steps where the oxide layers 36 and 38 are formed and probably when the roll of the film is subsequently exposed to atmosphere which also provides the film with the oxide layer 40. In this form of the invention, oxygen is forced into the film 11 of the dispersion imaging material during the deposition procedures as distinguished from the insertion of oxygen during the aging period as is the case in the form of the invention of FIG. 11.

After the film 11 of FIG. 12 is so formed, the polymer resin overcoat film 12, as discussed above, is deposited thereover in the manner discussed above in connection with FIG. 11 and following the deposition of the overcoat film 12, the imaging film, including the substrate 10, the film 11 of dispersion imaging material and the overcoat film 12, is heat treated or annealed in the manner discussed above in connection with FIG. 11. The final optical density of the film of FIG. 12 is substantially 1.2 as illustrated by the curve 2 in FIG. 1.

When sufficient energy is applied to the imaging film illustrated in FIG. 12 to cause the absorbed energy to increase in the film 11 of dispersion imaging material above the aforementioned critical value, the film 11 of FIG. 12 is changed to a substantial fluid state wherein the surface tension of the material acts to cause the film where subject to the applied energy to disperse and change to the continuous film comprising openings 18 and deformed material 19 as discussed above in connection with FIGS. 3 to 6 and 7 to 10. The openings begin to form at points indicated at 30 in FIG. 12 and the deformed material rolls back toward roll back point as indicated at 29 in FIG. 12.

The oxide layers 36, 38 and 40 and the oxides within the grain boundaries of the bismuth layers 35, 37 and 39 and the phase boundaries between the oxides and the bismuth material act as impediments and deterrents to the roll back of the dispersion imaging material, in its substantially fluid state, under the influence of the surface tension thereof and, therefore, retard the change to the discontinuous film and control the amount of such change in accordance with the intensity of the applied energy. In this respect, the phase boundary energies must be overcome and the oxides which remain substantially solid must be broken up and carried along by the substantially fluid material as the material is so rolled back by the surface tension of the material. Also, there is an interfacial adhesion between the film 11 of dispersion imaging material and the substrate 10 and the overcoat film 12 which also retards and controls the amount of the roll back of the dispersion imaging material in its substantially fluid state.

In another specific embodiment of this invention, a substrate 10, with or without the thin layer 11 of aluminum oxide, is placed in a vacuum deposition machine which is pumped down to a vacuum of about $7 \times 10^{-6}$ Torr. Bismuth in a resistance heated boat, which is located about 10 cm from the substrate 10, is vacuum deposited on the substrate at a rate of about 200 A/min. for a period of about 5 minutes to provide an optical density of about 1.8 and a thickness of about 1000 A. This produces a film 11 of bismuth on the substrate substantially as illustrated in FIG. 11 having grains 25, grain boundaries 27 therebetween and domed shaped ends 26 on the grains. Without breaking the vacuum, sulphur in a resistance heated boat also located about 10 cm from the substrate, starting about one minute after the deposition of the bismuth was completed, is vacuum deposited on top of the deposited bismuth film with an evaporation time of about 1 minute for providing a sulphur thickness of greater than 10 A and less than one micron. Thereafter, the overcoat film 12 is deposited on the film of dispersion imaging material and heated or annealed as described above in connection with the form of the invention illustrated in FIG. 11. The sulphur diffuses in the grain boundaries 27 of the bismuth grains 25 to provide a microheterogeneous structure like that illustrated in FIG. 11, with the exception that the different component 28 in phase boundary relation to the bismuth grains comprises sulphur instead of oxygen. Upon application of energy to this specific embodiment of the invention, the sulphur acts in substantially the same way as the oxygen discussed above in connection with FIG. 11 and continuous tone or gray scale imaging is obtained in substantially the same way as set forth above in connection with FIG. 11.

In a further specific embodiment of this invention, a substrate 10 is placed in a vacuum deposition machine, also having sputtering capabilities, and including a payoff roll for the substrate, a water cooled roll and a takeup roll for the substrate. An aluminum oxide cathode is located between the payoff roll and the water cooled roll for sputtering a thin aluminum oxide layer on the substrate as it is advanced from the payoff roll to the water cooled roll. A sublimator, including a radiation heater and containing tellurium and located adjacent the water cooled roll, operates to vacuum deposit the sublimated tellurium as a thin layer of aluminum oxide on the substrate as it is advanced thereby. The substrate including the deposits thereon is taken up on the takeup roll. An optical monitor is arranged between the water cooled roll and the takeup roll to monitor the optical density of the film.

This in line sputtering and vacuum deposition machine is pumped down to a vacuum of about $5 \times 10^{-6}$ Torr and then back filled with sputtering atmosphere, such as argon, to a vacuum of about $5 \times 10^{-3}$ Torr and the substrate is advanced from the payoff roll to the takeup roll at a speed of about 12 ft/min. with a deposition rate of the tellurium of about 25,000 A/min., giving an optical density of about 1.5 as determined by the optical monitor. Such tellurium coated substrate is then halogenated, as for example, by placing the same in a jar under normal ambient temperature and humidity conditions and containing iodine crystals which provide a saturated iodine atmosphere, for etching the tellurium.

The deposited tellurium has a substantially columnar or needle shaped structure having boundaries therebetween which are somewhat similar tothe grain boundaries 27 discussed above in connection with FIG. 11. After about the first two days in the iodine atmosphere, the relatively smooth surface of the deposited tellurium begins to show erosion, that is, a pocked marked surface, and after about 10 days the boundary etched regions of the tellurium become well defined. The outer surface of the tellurium film and the etched boundaries in the tellurium film comprise iodized and/or oxides which are components different from the tellurium material and, hence, provide phase boundaries therebetween in a microheterogeneous film structure.

Here, the structure of the film of dispersion imaging material is somewhat similar to that of FIG. 11, except that the tellurium and the bismuth oxides 28 of FIG. 11 are tellurium iodides and/or oxides. Optionally, the film, including the substrate 10 and the tellurium imaging material deposited thereon, may be heattreated or annealed as discussed above. A polymer resin overcoat film, as discussed above, is deposited over the teched tellurium film as described above in connection with FIG. 11. When sufficient energy is applied to this particular form of the imaging film to cause the absorbed energy to increase above the aforesaid critical value, the tellurium film is changed to its substantially fluid state and is dispersed and changed to the discontinuous film in substantially the same manner as discussed above in connection with FIG. 11 and provides continuous tone or gray scale imaging.

In still another specific embodiment of this invention, a substrate 10, which may have the sputtered aluminum oxide layer 31 thereon, is placed in a vacuum deposition machine having a payoff roll for the substrate, a water cooled roll, a takeup roll for the substrate, a resistance heater boat arranged about 6 inches below the water cooled roll and an optical monitor between the water cooled roll and the takeup roll for monitoring the optical density of the deposited material on the substrate, similar to the vacuum deposition machine discussed above in connection with FIG. 11. Bismuth is placed in the resistance heater boat to be vapor deposited therefrom onto the substrate.

The vacuum deposition machine is evacuated to about $9 \times 10^{-5}$ Torr and then clean and dry oxygen is introduced into the machine to bring up the pressure in the machine to about $5 \times 10^{-3}$ Torr. The bismuth is evaporated onto the substrate in this atmosphere as the substrate is advanced at a speed of about 1 to 4 ft/min. The optical density of the deposited material is about 1.5 as determined by the optical monitor and the thickness of the deposited film is generally about 1000 A.

By reason of the oxygen-containing atmosphere in the machine, oxygen is forced into the film during the deposition thereof to provide multiple components in the film, i.e., bismuth and bismuth oxide, with phase boundaries therebetween, the deposited film also being microheterogeneous in this respect. The microheterogeneous structure of the film may be somewhat similar to the structure illustrated in FIG. 11 but probably would be more random. Thereafter, the overcoat film 12 is deposited on the film of dispersion imaging material and may be heated or annealed if desired, as described above in connection with FIG. 11. Upon application of energy to this specific embodiment of the invention, continuous tone or gray scale imaging is obtained in substantially the same way as discussed above in connection with FIG. 11.

In a still further specific embodiment of this invention, a substrate 10 is placed in a vacuum deposition machine having a payoff roll for the substrate, a water cooled roll, a takeup roll for the substrate, a resistance heater boat arranged about 6 inches below the water cooled roll and an optical monitor between the water cooled roll and the takeup roll for monitoring the optical density of the deposited material on the substrate, similar to the vacuum deposition machine discussed above in connection with FIG. 11. In addition, the vacuum deposition machine includes a sputtering station between the payoff roll and the water cooled roll having a cathode of aluminum oxide ($Al_2O_3$) for sputtering aluminum oxide onto the resistance heater boat to be vapor deposited therefrom onto the substrate.

The vacuum deposition machine is evacuated to about $4 \times 10^{-6}$ Torr and then a sputtering atmosphere, such as argon gas, is introduced into the machine up to a pressure of about $4 \times 10^{-3}$ Torr. The substrate is advanced from the payoff roll past the aluminum oxide cathode and under the water cooled roll above the resistance heater boat to the takeup roll at a speed of about 4 ft/min. and a layer of aluminum oxide is sputtered onto the substrate and a layer of bismuth is deposited thereover to provide an optical density of about 0.5. The substrate, including the layers of aluminum oxide and bismuth, is then rewound from the takeup roll to the payoff roll and the aforementioned sputtering and vacuum deposition step is repeated two times. After the third sputtering and deposition step, the rolled substrate with the depositions thereon is removed from the takeup roll in the vacuum deposition machine.

By reason of the foregoing sputtering and deposition, a microheterogeneous dispersion imaging film structure is produced having multiple components, such as is illustrated in FIG. 12, having the substrate 10, an aluminum oxide layer 31, a bismuth layer 35, an aluminum oxide layer 36, a bismuth layer 37, an aluminum oxide layer 38, a bismuth layer 39, and probably an oxide layer 40 resulting from exposure of the deposited film to atmosphere following removal of the roll of film from the deposition machine.

After the film is so formed, the polymer resin overcoat film 12, as discussed above, is deposited thereover in the manner discussed above in connection with FIGS. 11 and 12, and following the deposition of the overcoat film 12, the imaging film including the substrate, the film 11 of dispersion imaging material and the overcoat film 12 may be heat-treated or annealed, if desired, in the manner discussed above in connection with FIGS. 11 and 12. Upon application of energy to this specific embodiment of the invention, continuous tone or gray scale imaging is obtained in substantially the same way as discussed above in connection with FIG. 12.

Figure 13:
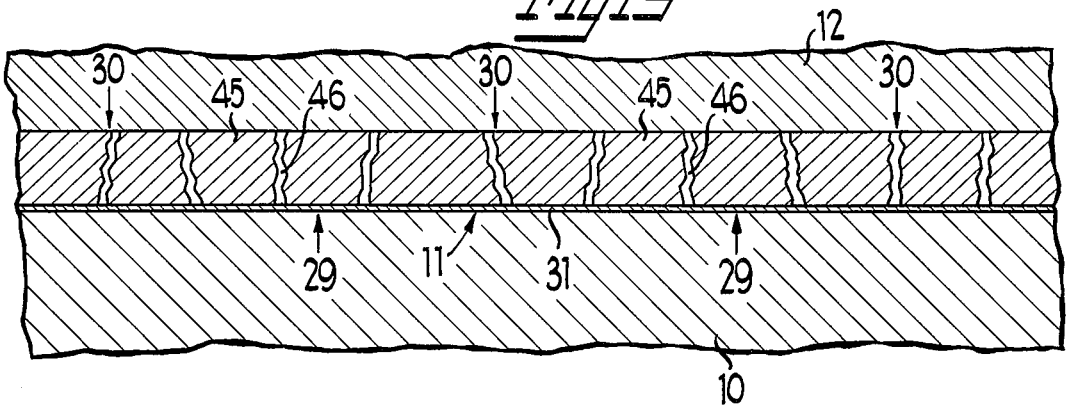

FIG. 13 is a sectional view similar to FIGS. 11 and 12 but illustrating a further form of the continuous tone dry process imaging film of this invention. It comprises the substrate 10 and the overcoat film 12 as discussed above and also the film 11 of dispersion imaging material. The film 11 which is deposited on the substrate 10, optionally with or without the layer 31, comprises a microheterogeneous structure including a plurality of different component materials 45 and 46 with phase boundaries between these different components, at least prior to the actual dispersion of the film 11 by the applied energy. In this particular embodiment, the component 45 comprises tellurium while the component 46 comprises germanium telluride, with the tellurium component 45 having a lower melting or softening point than the germanium telluride component 46.

The film 11 of dispersion imaging material, comprising the different components 45 and 46, is deposited on the substrate 10 preferably by a sputtering procedure. In this respect, appropriate proportions, as for example, 90 atomic percent tellurium and 10 atomic percent germanium, are heated to a molten state and mixed in a quartz vial and then quenched to a solid and removed from the vial. This product is then ground into a fine particulate and applied to a cathode target and placed in a sputtering machine having a water cooled support for the substrate 10 and a sputtering atmosphere, such as argon.

If the substrate 10 is relatively warm during the sputtering operation, as for example, above about 100° C, the particulate product is deposited on the substrate to provide the microheterogeneous structure of FIG. 13 including the tellurium grains 45, the germanium telluride 46 between such grains and phase boundaries therebetween. If the substrate 10 is relatively cold during the sputtering operation, for example, below about 70° C, the particulate product is deposited on the substrate to provide a substantially homogeneous and substantially amorphous structure. The overcoat film 12, as discussed above, is deposited on the outer surface of the film 11 as set forth above in connection with FIG. 11.

Where the deposited film 11 is substantially homogeneous and substantially amorphous, it may be converted to the microheterogeneous structure illustrated in FIG. 13 by heating the same above the glass transition temperature where the tellurium grains 45 and the germanium telluride material 46 between the grains rapidly form. This heating above the glass transition temperature may be accomplished in one way by heating the imaging film on a hot plate or the like. It also may be accomplished in another way during the application of the imaging energy to the film 11, where the applied imaging energy initially heats the film material above the glass transition temperature to provide the tellurium grains 45 and the germanium telluride material 46 therebetween before the applied energy becomes sufficient to increase the absorbed energy in the film 11 above the certain critical value where the film is changed to the substantially fluid state.

When sufficient energy is applied to the imaging film illustrated in FIG. 13 to cause the absorbed energy to increase in the film 11 of dispersion imaging material above the aforementioned critical value, the film 11 is changed to a substantially fluid state wherein the surface tension of the material acts to cause the film, where subject to the applied energy, to disperse and change to the discontinuous film comprising openings 18 and deformed material 19 as discussed above in connection with FIGS. 3 to 6 and 7 to 10. The openings usually begin to form at some of the phase boundaries between the tellurium grains 45 and the germanium telluride material 46 as indicated at 30 in FIG. 13 and the deformed material rolls back towards roll back points as indicated at 29 in FIG. 13. The germanium telluride 46 and the phase boundaries between the germanium telluride and the tellurium grains 45 act as impediments or deterrents to the roll back of the dispersion imaging material in its substantially fluid state under the influence of the surface tension thereof and, therefore, retard the change to the discontinuous film and control the amount of such change in accordance with the intensity of the applied energy. In this respect, the phase boundary energies must be overcome and the germanium telluride material, which remains substantially solid, must be broken up and carried along by the substantially fluid material as the material is so rolled back by the surface tension of the material. Also, there is an interfacial adhesion between the film 11 of the dispersion imaging material and the substrate 10 and/or the overcoat film 12 which also retards and controls the amount of roll back of the dispersion imaging material in its substantially fluid state.

Figure 14:
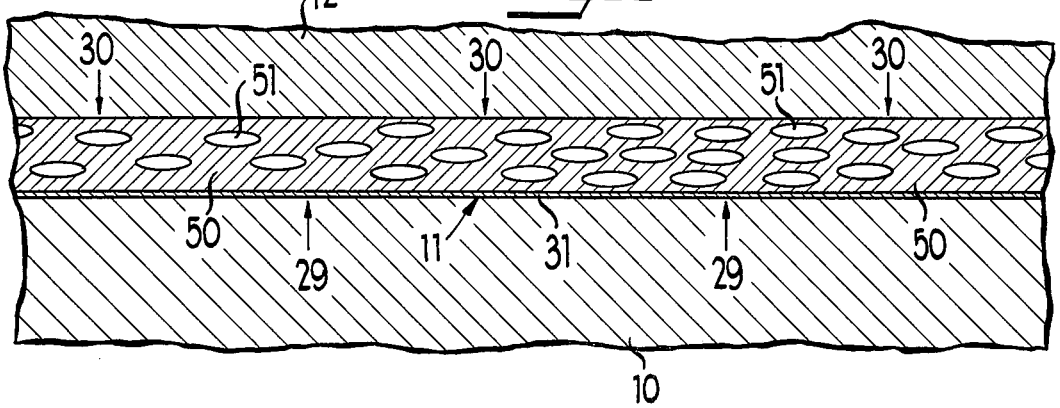
FIG. 14 is an enlarged sectional view similar to FIGS. 11, 12 and 13 but illustrating still another form of the instant invention.

Another and particularly important and beneficial embodiment of this invention is schematically illustrated in FIG. 14. It comprises the substrate 10 and the overcoat film 12 as discussed above and also a film 11 of dispersion imaging material. The film 11 which is deposited on the substrate, optionally with or without the layer 31, comprises an alloy of a plurality of mutually insoluble solid components and having a low melting point eutectic within its system. The film 11 is microheterogeneous having different solid components and phase boundaries therebetween. The film 11, upon application of energy in an amount sufficient to increase the absorbed energy in the film material above a certain critical value related to the low melting point value of the eutectic thereof, is capable of changing to a substantially fluid state in which the surface tension of the film material acts to cause the substantially opaque film, where subject to said energy, to disperse and change to a discontinuous film comprising openings and deformed material which are frozen in place following the application of the energy and through which openings light can pass for decreasing the optical density of the film thereat.

Since the film 11 of FIG. 14 comprises an alloy having a low melting point eutectic within its system, the certain critical value of the absorbed energy derived from the applied energy, which changes the film material to the substantially fluid state and allows the surface tension of the film material to disperse and change the film to the discontinuous film, is considerably less than for film materials not having a low melting point eutectic within their systems, such as the films containing bismuth as discussed above and the high contrast films as considered above and which also contain bismuth.

The effect of utilizing a film material having a low melting point eutectic in its system, such as binary and ternary eutectics including bismuth as a component thereof, is to displace the curves 1 and 2 of FIG. 1 to the left toward and up to the curves 7 and 8 of FIG. 1. Where the threshold value of the curve 1, which is for a high contrast bismuth film, is substantially 0.63 joules/cm$^2$, the threshold value of the displaced curve 7, which is for a high contrast film utilizing a ternary eutectic of bismuth-lead-tin, is about 0.28 joules/cm$^2$, demonstrating that only about one-half the energy is required for curve 7 than for curve 1. Substantially about the same decrease in energy applies for curve 8 as compared to curve 2. Thus, the imaging film having the bismuth-lead-tin ternary eutectic, which has a low eutectic melting point of about 95° C, is substantially twice as sensitive as the bismuth film without an eutectic wherein the bismuth itself has a melting point of about 275° C. For other bismuth eutectics, such as the binary eutectic of bismuth-lead having a melting temperature of about 125° C, and the binary eutectic of bismuth-tin having a melting point of about 139° C, generally will also displace the curves 1 and 2 of FIG. 1 to the left but not so far as curves 7 and 8. However, they generally appear to have a greater sensitivity than the bismuth films without the eutectic. The gammas of the curves 7 and 8 can be made to fall within a range of from about 1.5 to 15 depending upon the composition of the imaging film 11 and the deposition parameters therefor.

The microheterogeneous film 11 of FIG. 14, comprises, by way of example, the substantially mutually insoluble solid components of bismuth and lead and/or tin having a low melting point eutectic in its system, and generally for continuous tone or gray scale imaging it has an excess of at least one of these components. The eutectic compositions of these solid components are designated and cross sectioned at 50 in FIG. 14 even though such solid components form a microheterogeneous structure. The excess of said at least one of the components is designated at 51. For those alloys having an excess of bismuth over the eutectic, for example, the component designated at 51 at FIG. 14 comprises bismuth.

Some examples of compositions having the ternary eutectic Bi 52.5, Pb 32, Sn 15.6 in their systems and providing high sensitivity are by weight percent as follows:

Bi 60, Pb 20, Sn 20
Bi 70, Pb 20, Sn 10
Bi 80, Pb 10, Sn 10

Some examples of compositions having the binary eutectic Bi 55.5, Pb 44.5 in their systems and providing good cintinuous tone or gray scale imaging are by weight percent as follows:

Bi 90, Pb 10 Bi 70, Pb 30
Bi 80, Pb 20 Bi 60, Pb 40

Examples of other compositions having the binary eutectic Bi 58, Sn 42 and the binary eutectic Bi 60, Cd 42 are by weight percent as follows:

Bi 90, Sn 10
Bi 5, Cd 95

In the preparation of the alloys of this invention, including the above listed alloys, measured amounts of the respective components are placed in a quartz tube and heated to a molten state and mixed by shaking. The molten mixture is cast on a cold quartz plate and then pulverized in a mortar into fine particles like fine sand. In a small batch experiment, 20 mg. of the alloy particles are placed in a resistance heater deposition boat in a vacuum deposition machine about 4.5 inches below the substrate 10 carried on a water cooled plate and the machine is pumped down to about $4 \times 10^{-6}$ Torr. The contents of the boat are rapidly heated and evaporated for about 30 seconds until all of the alloy is evaporated. The alloy so deposited on the substrate provides an optical density of about 1.5. Where the alloy has a ternary eutectic in its system, a glass chimney about 4.5 inches in diameter is preferably placed between the substrrate and the evaporation boat to provide a more even deposition of the alloy on the substrate.

It is found that when the highly sensitive alloy having the ternary eutectic in its system is so deposited, it has enhanced continuous tone or gray scale properties when Dow Corning vacuum silicone grease is applied on the inside of the chimney during deposition. It is believed that this grease, including organic components, co-acts with the inorganic components of the alloys, probably at the phase boundaries of the latter, to provide the enhanced continuous tone or gray scale properties thereof.

After the film 11 of FIG. 14 is so formed, the overcoat film 12, as discussed above, is deposited thereover in the manner discussed above in connection with FIG. 11 and following the deposition of the overcoat film 12, the imaging material including the substrate 10, the film 11 of dispersion imaging material and the overcoat film 12, may, if desired, be heat treated or annealed in the manner discussed above in connection with FIG. 11. The final optical density of the film of FIG. 14 is substantially 1.2 as illustrated by the curve 8 in FIG. 1.

When sufficient energy is applied to the imaging film illustrated in FIG. 14 to cause the absorbed energy to increase in the film 11 of dispersion imaging material above the aforementioned critical value, which is related to the low melting point temperature of the eutectic, the film 11 of FIG. 14 is changed to a substantially fluid state wherein the surface tension of the material acts to cause the film where subject to the applied energy to disperse and change to the discontinuous film comprising openings 18 and deformed material 19 as discussed above in connection with FIGS. 3 to 6 and 7 to 10. The openings begin to form at points indicated at 30 in FIG. 14 and the deformed material rolls back toward roll back points as indicated at 29 in FIG. 14.

When the film 11 of FIG. 14 is in its substantially fluid state, the eutectic 50 of the alloy is substantially molten while the excess component 51 of the alloy having phase boundaries between the substantially molten and solid components 50 and 51 along with the solid component 51 act as impediments and deterrents to the roll back of the dispersion imaging material, in its substantially fluid state, under the influence of the surface tension thereof and, therefore, retard the change to the discontinuous film and control the amount of such change in accordance with the intensity of the applied energy. In this respect, the phase boundary energies must be overcome and the solid components must be carried along by the substantially fluid material as the material is so rolled back by the surface tension of the material. The amount of the solid component 51 in the film 11 is dependent upon the temperature of the film above the eutectic melting temperature and below the melting temperature of the excess component 51. As the temperature of the film 11 is increased above the eutectic melting temperature, the amount of the excess component 51 decreases so that for higher temperatures the impediment or retardation to the dispersion of the imaging material decreases. Therefore, the amount of the change to the discontinuous film is controlled in accordance with the intensity of the applied energy above the aforementioned certain critical value. In this way continuous tone or gray scale imaging of the film of FIG. 14 is obtained.

While specific reference has been made with respect to FIGS. 3 to 6 to the use of an imaging mask 13 and noncoherent radiant energy to increase the absorbed energy in the film 11 of dispersion imaging material above the certain critical value for changing the same to the fluid state, other forms of energy and manners of application may be utilized for this purpose within the scope of this invention. The applied energy may also comprise a beam of radiant energy, such as, a laser beam of coherent energy, which serially scans the film and which is intensity modulated. Laser beam imaging on a film is very inefficient, it requires high powered and expensive laser equipment and is not conducive to office use. By the use of the high sensitivity imaging materials of this invention comprising an alloy of a plurality of substantially mutually insoluble solid components and having a low melting point eutectic within its system, such as the aforementioned ternary eutectics, considerably less laser energy is required for laser imaging. As a result, lower powered and less expensive laser equipment may be utilized which is conducive to office use. This is also an important attribute of this invention. Continuous tone or gray scale imaging can be obtained in accordance with this invention by controlling the intensities of the intensity modulated laser beam.

The energy may also comprise joule heat energy applied to the film by means of, for example, direct electrical heating, electrically energized heating means or the like and absorbed in the film. The heating means may include a single heating point which serially scans the film and which is intensity modulated, or it may comprise an advanceable matrix of heating points which are intensity modulated. By the use of the high sensitivity imaging materials of this invention comprising an alloy of a plurality of substantially mutually insoluble solid components and having a low melting point eutectic within its system, such as the aforementioned ternary eutectics, considerably less energy is required for imaging the film, thereby decreasing substantially the heating of the film and eliminating damage to the film which might be occassioned by overheating the same. This is also an important attribute of this invention. Continuous tone or gray scale imaging can be obtained in accordance with this invention by controlling the intensities of the intensity modulations of the heating means.

The use of the high sensitivity imaging materials of this invention comprising an alloy of a plurality of substantially mutually insoluble solid components and having a low melting point eutectic within its system, such as the aforementioned ternary eutectics, is also highly beneficial where non-coherent radiant energy from a Xenon flash lamp or the like is applied through an imaging mask to such films. Here, also, a lesser amount of imaging energy is required so that the Xenon flash lamp or the like need not be operated near its upper limits. As a result, more even application of the Xenon flash energy through the mask with less possible distortion to the high sensitivity film is provided and the operating life of the Xenon flash lamp is greatly extended. Where the energy is applied in a short pulse, the pulse width may be within a range of about 30 microseconds to about 10 milliseconds, with a pulse width of about 100 microseconds giving exceedingly satisfactory results.

The layer 31 of aluminum oxide deposited on the substrate 20 before evaporating the film 11 of dispersion imaging material thereon also has the ability of substantially eliminating cracking of the film when it is subjected to the applied energy. Shelf life of the films may be improved and drops in optical density and film sensitivity may be reduced by depositing over the film 11 of dispersion imaging material a passivating layer, such as, sodium bichromate, silicon dioxide, silicon monoxide, or the like.

Where a fully formatted microfiche card such as designated at 55 in FIG. 2 is desired for micro-imaging information thereon in accordance with the imaging methods of this invention, the overcoat film 12 which is deposited on the film of imaging material 11 on the substrate 10 comprises a photoresist material such as polyvinylcinnamate, for example, a Kodak KPR-4 photoresist manufactured and sold by Eastman Kodak Company, this photoresist being negative working. The imaging film with such overcoat film is exposed through a master mask with the U.V., and the negative resist overcoat is U.V. activated with substantially $10^6$ ergs/cm$^2$ energy applied to the overcoat film. Where the U.V. energy is applied to the overcoat film, the overcoat film is rendered non-light sensitive and insensitive to subsequent solutions utilized in the development of the film.

The film is developed by passing the same through a Kodak orthoresist developer which removes the nonexposed portions of the overcoat film but leaving intact the exposed portions. The film is then rinsed and dried by evaporation. Thereafter, the film is passed through a solution, for example, of 10 percent ferric chloride in water and the exposed metal is etched thereby. Following the etching, the film is rinsed and dried. Thereafter, a release coat of Gantrey of GAF (AN 8194) in a substantially 4 percent toluene is applied to the outer surface of the film to a thickness of about 0.1 micron for the purpose of preventing sticking of the fiche cards 55 together and to the intermediate mask film by which it is to be later imaged. The release coat may be applied by spin coating, roller coating, spray coating or the like. This fully formatted film is then cut to standard fiche card size.

The fiche card 55 may include substantially opaque areas 56 upon which the micro-imaged information may be applied in accordance with this invention and clear transparent margins 57 therearound. The edges of the fiche card may be clear as indicated at 58 but still containing substantially opaque numbers and letters for indicating columns and rows. A portion 60 of the fiche card may be made transparent so as to readily place thereon title information relating to the fiche card. The upper left hand portion 59 of the fiche card may contain identfying monograms and the like. The upper right hand portion 61 of the fiche card is substantially opaque so that it can receive retrieval code information by the imaging method of this invention.

While for purposes of illustration various forms of this invention have been disclosed, other forms thereof may become apparent to those skilled in the art upon reference to this disclosure and, therefore, this invention should be limited only by the scope of the appended claims.

We claim:

1. A continuous tone dry process imaging film comprising a substrate, a solid, high optical density and substantially opaque film of a dispersion imaging material deposited on said substrate, said substantially opaque film of the dispersion imaging material, upon application of energy in an amount sufficient to increase the absorbed energy in the material above a certain critical value, being capable of changing to a substantially fluid state in which the surface tension of the material acts to cause the substantially opaque film where subject to said energy to disperse and change to a discontinuous film comprising openings and deformed material which are frozen in place following said application of energy and through which openings light can pass, and means associated with said film of imaging material for retarding the change to the discontinuous film, caused by the surface tension, and for controlling the amount of such change in accordance with the intensity of the applied energy above said certain critical value to increase the amount of said change and the area of the openings in the film and decrease the area of the deformed material in the film and, therefore, the optical density of the film in accordance with the intensity of the applied energy above said certain critical value for providing continuous tone imaging of the dry process imaging film.

2. A continuous tone dry process imaging film as defined in claim 1, wherein said retarding and controlling means comprises multiple different components and phase boundaries therebetween in the substantially opaque film of dispersion imaging material prior to dispersion thereof.

3. A continuous tone dry process imaging film as defined in claim 1, wherein said retarding and controlling means comprises a grain structure in the substantially opaque film of dispersion imaging material having grains which are substantially vertically oriented with respect to the substrate with substantially vertically oriented grain boundaries, and multiple components in the substantially opaque film of dispersion imaging material with the grain boundaries thereof having a component different from that of the grains to provide phase boundaries therebetween.

4. A continuous tone dry process imaging film as defined in claim 1, wherein said retarding and controlling means comprises an outer surface of the substantially opaque film of dispersion imaging material having a component different from that of the remainder of the film to provide phase boundaries therebetween.

5. A continuous tone dry process imaging film as defined in claim 1, wherein said retarding and controlling means comprises the substrate and the substantially opaque film of dispersion imaging material deposited thereon and the interfacial adhesion therebetween.

6. A continuous tone dry process imaging film as defined in claim 1, wherein said retarding and controlling means comprises an overcoat film deposited on the outer surface of said substantially opaque film of dispersion imaging material, and the interfacial adhesion between the substantially opaque film of dispersion imaging material and the overcoat film deposited thereon.

7. A continuous tone dry process imaging film as defined in claim 1, wherein said substantially opaque film of dispersion imaging material has a grain structure comprising grains which are relatively small in width, which are substantially vertically oriented with respect to the substrate with substantially vertically oriented grain boundaries therebetween, and which are substantially dome shaped at the outer surface of the film.

8. A continuous tone dry process imaging film as defined in claim 7, wherein said retarding and controlling means comprises an overcoat film deposited on the outer surface of said substantially opaque film of dispersion imaging material, and the interfacial adhesion between the substantially dome shaped grains at the outer surface of the substantially opaque film of dispersion imaging material and the overcoat film deposited thereon.

9. A continuous tone dry process imaging film as defined in claim 7, wherein the outer surfaces of the substantially dome shaped grains of the film have a coating of a component different from that of the grains themselves to provide phase boundaries therebetween.

10. A continuous tone dry process imaging film as defined in claim 9, wherein said retarding and controlling means comprises the coating of the component on the outer surfaces of the substantially dome shaped grains different from that of the grains themselves, and also an overcoat film deposited on the outer surface of said coating on the substantially opaque film of dispersion imaging material, and the interfacial adhesion between the substantially dome shaped grains at the outer surface of the substantially opaque film of dispersion imaging material and the overcoat film deposited thereon.

11. A continuous tone dry process imaging film as defined in claim 7, wherein the grain boundaries of the film have a coating of a component different from that of the grains to provide phase boundaries therebetween.

12. A continuous tone dry process imaging film as defined in claim 11, wherein said retarding and controlling means comprises the coating of the component of the grain boundaries different from that of the grains, and also an overcoat film deposited on the outer surface of said substantially opaque film of dispersion imaging material, and the interfacial adhesion between the substantially dome shaped grains at the outer surface of the substantially opaque film of dispersion imaging material and the overcoat film deposited thereon.

13. A continuous tone dry process imaging film as defined in claim 7, wherein the outer surfaces of the substantially dome shaped grains of the film and the grain boundaries of the film have a coating of a component different from that of the grains to provide phase boundaries therebetween.

14. A continuous tone dry process imaging film as defined in claim 13, wherein said retarding and controlling means comprises the coating of the component of the outer surfaces of the substantially dome shaped grains and of the grain boundaries different from that of the grains themselves, and also an overcoat film deposited on the outer surface of said substantially opaque film of dispersion imaging material, and the interfacial adhesion between the overcoat film and the substantially dome shaped grains at the outer surface of the substantially opaque film of dispersion imaging material and the overcoat film deposited thereon.

15. A continuous tone dry process imaging film as defined in claim 1, wherein said substantially opaque film of dispersion imaging material has a structure comprising deposited alternating layers of different components and phase boundaries therebetween substantially parallely oriented with respect to the substrate.

16. A continuous tone dry process imaging film as defined in claim 15, wherein said retarding and controlling means comprises the different components of the deposited alternating layers, and also an overcoat film deposited on the outer surface of said substantially opaque film of dispersion imaging material, and the interfacial adhesion between the outer surface of the substantially opaque film and the overcoat film deposited thereon.

17. A continuous tone dry process imaging film as defined in claim 1, wherein said substantially opaque film of dispersion imaging material comprises an alloy, having a eutectic within its system, of a plurality of substantially mutually insoluble solid components having an excess of at least one of the components so that the alloy is off the eutectic of the alloy system.

18. A continuous tone dry process imaging film as defined in claim 17, wherein said retarding and controlling means comprises said at least one of the solid components of the alloy in the fluid state above the eutectic temperature.

19. A continuous tone dry process imaging film as defined in claim 18, wherein said retarding and controlling means also comprises an overcoat film deposited on the outer surface of said substantially opaque film of dispersion imaging material, and the interfacial adhesion between the outer surface of the substantially opaque film of dispersion imaging material and the overcoat film deposited thereon.

20. A continuous tone dry process imaging film as defined in claim 1, wherein said substantially opaque film of dispersion imaging material comprises a microheterogeneous structure of a plurality of different solid components having different fluid forming temperatures.

21. A continuous tone dry process imaging film as defined in claim 20, wherein said retarding and controlling means comprises at least one of said solid components in the material when the other components thereof are in the fluid state.

22. A continuous tone dry process imaging film as defined in claim 21, wherein said retarding and controlling means also comprises an overcoat film deposited on the outer surface of said substantially opaque film of dispersion imaging material, and the interfacial adhesion between the outer surface of the substantially opaque film of dispersion imaging material and the overcoat film deposited thereon.

23. A continuous tone dry process imaging film as defined in claim 2, wherein one of said multiple components comprises bismuth.

24. A continuous tone dry process imaging film as defined in claim 23, wherein another of said multiple components comprises oxygen.

25. A continuous tone dry process imaging film as defined in claim 23, wherein another of said multiple components comprises aluminum oxide.

26. A continuous tone dry process imaging film as defined in claim 23, wherein another of said multiple components comprises lead.

27. A continuous tone dry process imaging film as defined in claim 23, wherein another of said multiple components comprises tin.

28. A continuous tone dry process imaging film as defined in claim 23, wherein another of said multiple components comprises cadmium.

29. A continuous tone dry process imaging film as defined in claim 2, wherein one of said multiple components comprises tellurium.

30. A continuous tone dry process imaging film as defined in claim 29 wherein another of said multiple components comprises iodine.

31. A dry process high sensitivity imaging film comprising a substrate, a solid, high optical density and substantially opaque film of a dispersion imaging material deposited on said substrate, said film material comprising a microheterogeneous alloy of a plurality of substantially mutually insoluble solid components and having a low melting point eutectic within its system, said film, upon application of energy in an amount sufficient to increase the absorbed energy in the film material above a certain critical value related to the low melting point value of the eutectic thereof, being capable of changing to a substantially fluid state in which the surface tension of the film material acts to cause the substantially opaque film, where subject of said energy, to disperse and change to a discontinuous film comprising openings and deformed material which are frozen in place following said application of energy and through which openings light can pass for decreasing the optical density of the film thereat.

32. A dry process high sensitivity imaging film as defined in claim 31, wherein means are associated with said film of imaging material for retarding the change to the discontinuous film, caused by the surface tension, and for controlling the amount of such change in accordance with the intensity of the applied energy above said certain critical value to increase the amount of said change and the area of the openings in the film and decrease the area of the deformed material in the film and, therefore, the optical density of the film in accordance with the intensity of the applied energy above said certain critical value for providing continuous tone imaging of the dry process imaging film.

33. A dry process high sensitivity imaging film as defined in claim 32, wherein said retarding and controlling means includes components and phase boundaries in the imaging material in addition to the components forming the eutectic in the imaging material.

34. A dry process high sensitivity imaging film as defined in claim 31, wherein said alloy of said plurality of substantially mutually insoluble solid components has an excess of at least one of the components so that the alloy is off the eutectic of the alloy system.

35. A dry process high sensitivity imaging film as defined in claim 34, wherein, in the substantially fluid state of the film above the low melting point value of the eutectic, said excess of said at least one of the solid components remains solid up to its melting point and in amount depending upon its temperature below its melting point, retards the change of the film to the discontinuous film, caused by the surface tension, and controls the amount of such change in accordance with the intensity of the applied energy above said certain critical value to increase the amount of such change and the area of the openings in the film and decrease the area of the deformed material in the film and, therefore, the optical density of the film in accordance with the intensity of the applied energy above said certain critical value for providing continuous tone imaging of the high sensitivity dry process imaging film.

36. A dry process high sensitivity imaging film as defined in claim 31, wherein an overcoat film is deposited on the outer surface of said substantially opaque film of dispersion imaging material.

37. A dry process high sensitivity imaging film as defined in claim 31, wherein one of said components of said alloy comprises bismuth.

38. A dry process high sensitivity imaging film as defined in claim 37, wherein another of said components of said alloy comprises lead.

39. A dry process high sensitivity imaging film as defined in claim 37, wherein another of said components of said alloy comprises tin.

40. A dry process high sensitivity imaging film as defined in claim 37, wherein another of said components of said alloy comprises lead and tin.

41. A dry process high sensitivity imaging film as defined in claim 37, wherein another of said components of said alloy comprises cadmium.

* * * * *